US005881953A

United States Patent [19]

Moroi et al.

[11] Patent Number: 5,881,953

[45] Date of Patent: Mar. 16, 1999

[54] VISCOUS FLUID TYPE HEAT GENERATOR WITH HEAT GENERATION INCREASING MEANS

[75] Inventors: Takahiro Moroi; Kiyoshi Yagi; Hidefumi Mori; Takashi Ban; Tatsuyuki Hoshino; Tatsuya Hirose, all of Kariya, Japan

[73] Assignee: Kabushiki Kaisha Toyoda Jidoshokki Seisakusho, Kariya, Japan

[21] Appl. No.: 924,543

[22] Filed: Aug. 27, 1997

[30] Foreign Application Priority Data

Aug. 27, 1996 [JP] Japan ..... 8-225557
Oct. 31, 1996 [JP] Japan ..... 8-290742

[51] Int. Cl.[6] ..... B60H 1/02

[52] U.S. Cl. ..... 237/12.3 R; 122/26; 126/247

[58] Field of Search ..... 237/12.3 B, 12.3 R; 122/26; 126/247

[56] References Cited

U.S. PATENT DOCUMENTS 4,312,322 1/1982 Freihage .
4,419,980 12/1983 Leary et al. ..... 126/247

FOREIGN PATENT DOCUMENTS 2246823 10/1990 Japan .
357877 3/1991 Japan .

*Primary Examiner*—Henry A. Bennett
*Assistant Examiner*—Derek S. Boles
*Attorney, Agent, or Firm*—Burgess, Ryan & Wayne

[57] ABSTRACT

A viscous fluid type heat generator including a housing assembly in which a fluid-tight heat generating chamber confining therein a viscous fluid to which a shearing action is applied by a disc-like rotor element rotated by a drive shaft, and having inner wall surfaces confronting outer surfaces of the rotor element, the inner wall surfaces of the fluid-tight heat generating chamber and the outer faces of the rotor element defining a gap in which the viscous fluid is held, the rotor element being provided with one or more through-holes formed in an outer peripheral portion and a radially inner portion thereof with respect to the axis of rotation of the rotor element so that the through-holes cooperate with one or more non-circumferentially extending elongate indentations provided in the inner wall surfaces of the fluid-tight heat generating chamber during the rotation of the rotor element to expand a heat generating region formed by the gap. The expansion of the heat generating region formed by the gap increases a restraint acting against movement of the viscous fluid caused by the rotation of the rotor element so as to increase friction and a shearing force acting on the viscous fluid, and heat generation by the viscous fluid is increased.

23 Claims, 12 Drawing Sheets

VISCOUS FLUID TYPE HEAT GENERATOR WITH HEAT GENERATION INCREASING MEANS

BACKGROUND OF THE INVENTION

1. Field of the Invention

The present invention relates to a viscous fluid type heat generator in which a viscous fluid is subjected to a shearing action to generate heat that is in turn transmitted to a circulating heat-transfer or heat-exchange fluid in a heat receiving chamber, and is carried by the heat-transfer fluid to a desired heated area, such as a passenger compartment in an automobile. More particularly, the present invention relates to a viscous fluid type heat generator adapted for being used as a supplementary heat source incorporated in an automobile heating system, provided with a heat generation augmenting means incorporated therein.

2. Description of the Related Art

Japanese Unexamined Patent Publication (Kokai) No. 2-246823 (JP-A-2-246823) discloses a typical automobile heating system in which a viscous fluid type heat generator, to generate heat by using a viscous fluid generating heat when it is subjected to shearing action, is incorporated. The viscous fluid type heat generator disclosed in JP-A-2-246823 includes a pair of mutually opposing front and rear housings tightly secured together by appropriate tightening elements, such as through bolts, to define an inner heat generating chamber and a heat receiving chamber arranged adjacently to the heat generating chamber. The fluid-tight heat generating chamber is formed as a fluid-tight chamber and is isolated from the heat receiving chamber by a partition wall through which the heat is exchanged between the viscous fluid in the fluid-tight heat generating chamber and the water in the heat receiving chamber. The heat exchanging water is introduced into the heat receiving chamber through a water inlet port and delivered from the heat receiving chamber toward an external heating system, and the water is constantly circulated through the heat generator and the external heating system.

A drive shaft is rotatably supported in the front housing via anti-friction bearing so as to support thereon a rotor element in such a manner that the rotor element is rotated with the drive shaft within the fluid-tight heat generating chamber. The rotor element has outer faces which are face-to-face with the inner wall surfaces of the fluid-tight heat generating chamber and form therebetween a small gap in the shape of labyrinth grooves, and a viscous fluid is supplied into the fluid-tight heat generating chamber so as to fill the small gap, i.e., the labyrinth grooves between the rotor element and the wall surfaces of the fluid-tight heat generating chamber.

When the drive shaft of the viscous fluid type heat generator incorporated in the automobile heating system is driven by an automobile engine, the rotor element is also rotated within the fluid-tight heat generating chamber so as to apply a shearing action to the viscous fluid held between the wall surfaces of the fluid-tight heat generating chamber and the outer faces of the rotor element. Thus, the viscous fluid which generally consists of a polymer material, typically a silicone oil having a chain molecular structure presenting a high viscosity, generates heat due to the shearing action applied thereto. The heat is transmitted from the viscous fluid to the heat exchanging water flowing through the heat receiving chamber. The heat exchanging water carries the heat to the heating circuit of the automobile heating system.

In the viscous fluid type heat generator, the amount of heat generation depends on an extent of contact area of the viscous fluid with the outer faces of the rotor element and with the inner wall surfaces of the fluid-tight heat generating chamber. Namely, when the contact area is large, the heat generation by the viscous fluid is energized to supply a large amount of heat.

On the other hand, when a viscous fluid type heat generator is used as a supplementary heat source for an automobile heating system, the heat generator must be as compact as possible so as to permit the heat generator, per se, and all the other various auxiliary equipment of the automobile, to be mounted in a limited mounting area in an engine compartment. To this end, the conventional viscous fluid type heat generator is internally provided with labyrinth grooves formed in the fluid-tight heat generating chamber in order to expand the fluid-tight space defined between the axially opposite end faces of the rotor element and the inner wall surfaces of the housing, and filled with the viscous fluid generating heat during the rotation of the rotor element. Namely, an expansion in the contact area of the viscous fluid with the end faces of the rotor element and the inner wall surfaces of the housing is achieved by the provision of the labyrinth grooves without causing an increase in the entire physical size of the viscous fluid heat generator.

Nevertheless, the provision of the above-mentioned labyrinth in the fluid-tight heat generating chamber is very cumbersome from the point of view of manufacturing technique, and is disadvantage from the point of view of preventing manufacturing cost of the heat generator.

Further, in the conventional viscous fluid type heat generator, the labyrinth provided in the heat generating chamber is arranged so that labyrinth-forming projections formed in the inner wall surfaces of the housing and those formed in the outer faces of the rotor element extend concentrically with one another about the axis of rotation of the rotor element. Therefore, when both labyrinth-forming projections are inaccurately manufactured and assembled, the rotor element might mechanically interfere with the housing when the former is rotated.

Japanese Unexamined (Kokai) Patent publication No. 3-57877 (JP-A-3-57877) discloses a different type of viscous fluid type heat generator in which a rotor element rotated by a drive shaft is housed in a chamber of a rotatable body formed by a pair of confronting cover and housing. A radially outer portion of the rotor element and a confronting portion of the housing are provided with labyrinth-forming projections extending circumferentially to form a fluid-tight labyrinth generally extending in a circumferential direction. A heat generating gap is defined in the fluid-tight labyrinth, and filled with viscous fluid such as silicone oil, to perform heat generation in response to an application of shearing action to the fluid. Namely, the fluid-tight labyrinth is provided as a means for making the heat generating region as large as possible.

The cover is provided with an impeller arranged in a heat receiving chamber so as to provide a resistance against the rotation of the rotatable body. The rotation of the rotor element causes rotation of the rotatable body via the viscous fluid. At this stage, due to provision of the impeller, there occurs a difference in speed between the rotation of the rotor element and that of the rotatable body, and therefore, heat is generated by the viscous fluid held in the heat generating gap in the fluid-tight labyrinth.

Although the rotor element of JP-A-3-57877 is provided with one or a plurality of through-holes formed in a radially inner portion thereof, these through-holes do not increase an amount of generation of heat by the viscous fluid. This is because the viscous fluid is mainly filled in the above-mentioned annular heat generating gap in the fluid-tight labyrinth region, and is not filled in the region located adjacent to the through-holes. Therefore, the through-holes do not act so as to increase the strength of the shearing action applied to the viscous fluid, and should be considered as passageway means for providing a fluid communication between both sides of the rotor element, and for permitting the viscous fluid to pass therethrough as required.

SUMMARY OF THE INVENTION

Therefore, an object of the present invention is to provide a viscous fluid type heat generator provided with an ability of increasing heat generation by the viscous fluid without a dimensional expansion of a heat generating gap formed between inner wall surfaces of a fluid-tight heat generating chamber and outer faces of a rotor element.

Another object of the present invention is to provide a viscous fluid type heat generator provided with a means for applying an effective shearing action to the viscous fluid to thereby increase an amount of generation of heat by the viscous fluid.

In accordance with one aspect of the present invention, there is provided a viscous fluid type heat generator which comprises:

- a housing assembly defining therein a fluid-tight heat generating chamber in which heat is generated, and a heat receiving chamber arranged adjacent to the fluid-tight heat generating chamber for permitting a heat exchanging fluid to circulate therethrough to thereby receive heat from the fluid-tight heat generating chamber, the fluid-tight heat generating chamber having inner wall surfaces thereof;
- a drive shaft supported by the housing assembly to be rotatable about an axis of rotation thereof, the drive shaft being operationally connected to an external rotation-drive source;
- a rotor element mounted to be rotationally driven by the drive shaft for rotation together therewith within the fluid-tight heat generating chamber, the rotor element having outer faces confronting the inner wall surfaces of the fluid-tight heat generating chamber via a predetermined amount of gap; and,
- a viscous fluid, filling the gap between the inner wall surfaces of the fluid-tight heat generating chamber of the housing assembly and the outer faces of the rotor element, for heat generation by the rotation of the rotor element,
- wherein the rotor element is provided with a first recess means formed in an outer peripheral portion thereof, and,
- wherein the inner wall surfaces of the fluid-tight heat generating chamber is provided with a second recess means arranged in a portion thereof permitting the second recess means to confront at least a portion of the first recess means in response to the rotation of the rotor element, the first and second recess means cooperating with one another to expand a region formed by the gap of the fluid-tight heat generating chamber when the rotor element is rotated.

The first recess means formed in the outer peripheral portion of the rotor element includes at least one through-hole arranged to pierce opposite circular faces of the rotor element at a position in the outer peripheral portion of the rotor element.

Preferably, the first recess means of the rotor element includes a plurality of through-holes arranged to pierce the opposite circular faces of the rotor element at equiangularly spaced plurality of positions in the outer peripheral portion of the rotor element.

Preferably, the through-hole is formed by a through-hole in the shape of a circle having a center thereof located at a position radially spaced from the axis of rotation of the rotor element by a distance equal to or larger than ($0.3\times r_0$), and a radius in the range of ($0.05\times r_0$ through $0.15\times r_0$), where "$r_0$" indicates the radius of the rotor element.

Alternatively, the first recess means formed in the outer peripheral portion of the rotor element may include at least one cutaway portion arranged in an outer circumference of the rotor element.

Preferably, the second recess means of the inner wall surfaces of the fluid-tight heat generating chamber includes at least one indentation formed in respective inner wall surface portions of the inner wall surfaces which face opposite circular end faces of the rotor element, and arranged to extend in a direction different from a circumferential direction about the axis of rotation of the rotor element.

The second recess means of the inner wall surfaces of the heat generating chamber may include a plurality of indentations formed in respective inner wall surface portions of the inner wall surfaces which face opposite circular end faces of the rotor element and are arranged to extend in a direction different from a circumferential direction about the axis of rotation of the rotor element.

Preferably, the indentation formed in the inner wall surface portions of the inner wall surfaces of the fluid-tight heat generating chamber includes an elongate indentation having a center line angularly shifted from a radial line in a direction corresponding to the direction of rotation of the rotor element so that the viscous fluid is moved radially toward a radially outer region from a radially inner region of the rotor element by the guidance of the elongate indentation during the rotation of the rotor element.

When the first recess means of the rotor element includes the plurality of through-holes or cutaway portions arranged at a plurality of equiangularly spaced positions in the outer peripheral portion of the rotor element, and when the second recess means of the inner wall surfaces of the fluid-tight heat generating chamber includes the plurality of indentations arranged at a plurality of equiangularly spaced positions, the space between the two neighboring through-holes or cutaway portions of the rotor element is preferably different from that between the two neighboring indentations of the inner wall surfaces of the fluid-tight heat generating chamber.

Preferably, at least one of the first recess means of the rotor element and the second recess means of the inner wall surfaces of the fluid-tight heat generating chamber is provided with acute edges at portions thereof exposed to the gap.

Preferably, the housing assembly further defines a fluid storing chamber fluidly communicating with the fluid-tight heat generating chamber by a fluid supplying passageway and a fluid withdrawing passageway, and the fluid storing chamber has a capacity thereof sufficient for storing a given volume of the viscous fluid which is larger than the capacity of the predetermined gap between the inner wall surfaces of the fluid-tight heat generating chamber and the outer faces of the rotor element.

Alternatively, the housing assembly further defines a heat generation control chamber fluidly communicating with the heat generating chamber by a fluid supplying passageway and a fluid withdrawing passageway. One of the fluid supplying and fluid withdrawing passageways is preferably arranged to be opened and closed by a valve means, so that when the viscous fluid may be withdrawn from the fluid-tight heat generating chamber into the heat generation control chamber via the fluid withdrawing passageway, heat generating performance of the heat generator is reduced, and when the viscous fluid may be supplied from the heat generation control chamber into the fluid-tight heat generating chamber via the fluid supplying passageway, the heat generating performance of the heat generator is increased.

In accordance with another aspect of the present invention, there is provided a viscous fluid type heat generator which comprises:

a housing assembly defining therein a fluid-tight heat generating chamber in which heat is generated and a heat receiving chamber arranged adjacent to the fluid-tight heat generating chamber for permitting a heat exchanging fluid to circulate therethrough to thereby receive heat from the fluid-tight heat generating chamber, the fluid-tight heat generating chamber having inner wall surfaces thereof;

an axial drive shaft supported by the housing assembly to be rotatable about an axis of rotation thereof, the drive shaft being operationally connected to an external rotation-drive source;

a rotor element mounted to be rotationally driven by the drive shaft for rotation together therewith within the fluid-tight heat generating chamber, the rotor element having front and rear opposite end faces and an outer circumferential face which confront the inner wall surfaces of the fluid-tight heat generating chamber via predetermined amount of gaps; and, a viscous fluid, filling at least the gaps between the inner wall surfaces of the fluid-tight heat generating chamber of the housing assembly and the front and rear opposite end faces of the rotor element, for heat generation by the rotation of the rotor element, wherein the rotor element is provided with at least one first through-hole axially piercing a portion thereof extending around and arranged radially adjacent to an axis of rotation of the rotor element, the first through-hole permitting the viscous fluid held in the predetermined gaps to pass therethrough from one side to the other of the rotor element.

Preferably, the rotor element is further provided with a recess means formed therein at a portion of at least one of the front and rear end faces thereof, and located radially outside the first through-hole.

The recess means may comprise at least one second through-hole piercing the front and rear end faces of the rotor element.

When the rotor element is provided with the first through-hole along with the above-mentioned recess means, the inner wall surfaces of the fluid-tight heat generating chamber may be provided with a recessed portion formed therein and confronting the recess means of the rotor element during the rotation of the rotor element.

The recessed portion of the inner wall surfaces of the fluid-tight heat generating chamber may comprise at least one elongate indentation formed therein and having a portion thereof confronting the recess means of the rotor element during the rotation of the rotor element, the elongate indentation being arranged to extend in a direction different from a circumferential direction with respect to the axis of rotation of the rotor element.

When the rotor element is provided with a plurality of radially inner first through-holes and a plurality of radially outer second through-holes, and when the inner wall surfaces of the fluid-tight heat generating chamber is provided with a plurality of indentations, the first and second through-holes of the rotor element as well as the indentations of the inner wall surfaces of the fluid-tight heat generating chamber are arranged at respective predetermined circumferential spaces about the axis of rotation of the rotor element.

In accordance with a further aspect of the present invention, there is provided a viscous fluid type heat generator which comprises:

a housing assembly defining therein, a fluid-tight heat generating chamber in which heat is generated, and a heat receiving chamber arranged adjacent to the fluid-tight heat generating chamber for permitting a heat exchanging fluid to circulate therethrough to thereby receive heat from the fluid-tight heat generating chamber, the fluid-tight heat generating chamber having inner wall surfaces thereof;

an axial drive shaft supported by the housing assembly to be rotatable about an axis of rotation thereof, the drive shaft being operationally connected to an external rotation-drive source;

a rotor element in the form of a disc mounted to be rotationally driven by the drive shaft for rotation together therewith within the fluid-tight heat generating chamber, the rotor element having front and rear opposite end faces and an outer circumferential face which cooperate with the inner wall surfaces of the fluid-tight heat generating chamber to define predetermined amount of gaps therebetween; and, a viscous fluid filling the gaps for heat generation by the rotation of the rotor element, wherein the rotor element is provided with a plurality of first through-holes piercing a radially central portion of the rotor element and a plurality of second through-holes piercing a radially outer portion of the rotor element, the first and second through-holes being arranged at predetermined respective angular spaces, and, wherein the inner wall surfaces of the fluid-tight heat generating chamber are provided with a plurality of indentations formed in a surface wall portion thereof confronting the opposite end faces of the rotor element and arranged at a predetermined angular space, each indentation being elongate to have a centerline thereof angularly shifted from a radial line in a rotating direction of the rotor element about the axis of rotation of the rotor element.

BRIEF DESCRIPTION OF THE DRAWINGS

The above and other objects, features and advantages of the present invention will be made more apparent from the ensuing description of preferred embodiments in conjunction with the accompanying drawings wherein.

DESCRIPTION OF THE PREFERRED EMBODIMENTS

Figure 1:
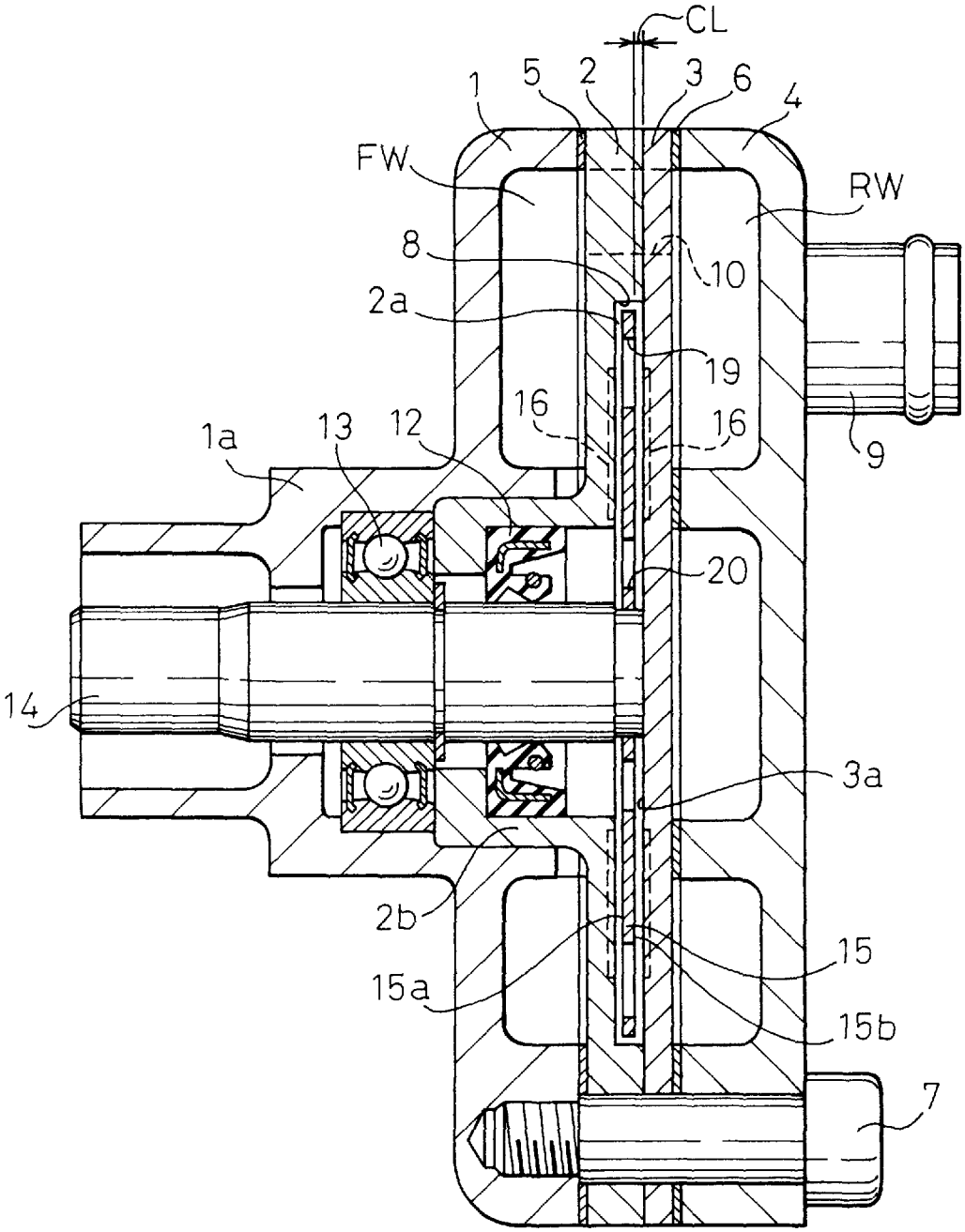
FIG. 1 is a longitudinal cross-sectional view of a viscous fluid type heat generator according to a first embodiment of the present invention.

Referring to FIGS. 1 through 8, illustrating a viscous fluid type heat generator according to the first embodiment, the heat generator includes a front housing body 1, a front plate element 2, a rear plate element 3 and a rear housing body 4 axially and tightly combined together by a plurality of screw bolts 7 to form a housing assembly of the heat generator. A gasket 5 is interposed between the front housing body 1 and the front plate element 2 to hermetically seal therebetween, and a gasket 6 is interposed between the rear plate element 3 and the rear housing body 4 to hermetically seal therebetween.

The housing assembly has a front housing portion formed by the front housing body 1 and the front plate element 2, and a rear housing portion formed by the rear plate element 3 and the rear housing body 4. The front plate element 2 has axially opposite front and rear faces, and the rear face is provided with a circular recess formed therein to have a flat circular end face 2*a* cooperating with a flat circular front end face 3*a* of the rear plate element 3 in defining a cylindrical heat generating chamber 8 which may be considered as a fluid-tight chamber.

The front housing body 1 is provided with an inner annular recess, formed in an inner face thereof, and cooperating with the front face of the front plate element 2 to define a front heat receiving chamber FW arranged adjacent to the front side of the fluid-tight heat generating chamber 8.

The rear housing body 4 is internally provided with radially inner and outer ribs extending annularly and projecting axially toward the gasket 6 so as to be tightly engaged with the gasket 6. A portion of the inner face of the rear housing body 4 located radially outside the inner rib and a portion of the rear end face of the rear plate element 3 defines a rear heat receiving chamber RW which is arranged adjacent to the rear side of the fluid-tight heat generating chamber 8.

The rear housing body 4 is provided with a rear end face having an inlet port 9 directly communicating with the rear heat receiving chamber RW and an outlet port (not shown) arranged at an outer peripheral portion of the rear end face so as to directly communicate with the rear heat receiving chamber RW. The inlet port 9 is provided for introducing heat exchanging liquid into the front and rear heat receiving chambers RW and FW, and the outlet port is provided for delivering the heat exchanging liquid from the heat receiving chambers FW and RW toward the external heating system. The outlet port is arranged circumferentially adjacent to the inlet port 9.

A plurality of equiangularly arranged passageways 10 are formed in outer peripheral portions of the front and rear plate elements 2 and 3, so as to provide a fluid communication between the front and rear heat receiving chambers FW and RW. Two neighboring passageways 10 are arranged circumferentially on both sides of one of the screw bolts 7 axially tightly combining the front housing body 1, the front plate element 2, the rear plate element 3 and the rear housing body 4 of the housing assembly.

The front plate element 2 is provided with a boss 2*b* at a central portion thereof for housing a shaft sealing device 12 therein. The shaft sealing device 12 is arranged adjacent to the fluid-tight heat generating chamber 8.

The front housing body 1 is provided with an axially outwardly projecting boss portion la which houses a front bearing device 13 supporting a central portion of a drive shaft 14. Namely, the drive shaft 14 typically arranged in a substantially horizontal state is supported by the bearing devices 13 and by the shaft sealing device 12 to be rotatable about an axis of rotation extending horizontally. A rotor element 15 in the shape of a flat disc is mounted and tightly fitted on an axial rear end of the drive shaft 14, and arranged to be rotated by the drive shaft 14 about an axis of rotation thereof within the fluid-tight heat generating chamber 8. The rotor element 15 has axially opposite circular faces 15*a* and 15*b*, and a circumference, which form the outer faces of the rotor element 15. The rotor element 15 has an outer diameter (radius is "$r_0$") which is slightly smaller than the diameter of the inner circumference of the fluid-tight heat generating chamber 8. A gap between each of the front and rear end faces 15*a* and 15*b* of the rotor element 15 and each of the confronting inner wall surfaces 2*a* and 3*a* of the heat generating chamber 8 is formed as a gap having an axial width "CL" which is set to be $0.003 \times r_0$.

The fluid-tight heat generating chamber 8 is supplied with viscous fluid having a chain molecular structure therein, e.g., a silicone fluid.

The drive shaft 14 is formed to be connected to a rotational drive source such as an automobile engine via a pulley or a solenoid clutch mounted on a front end of the drive shaft 14, and to be driven by the rotational drive source.

Figure 2:
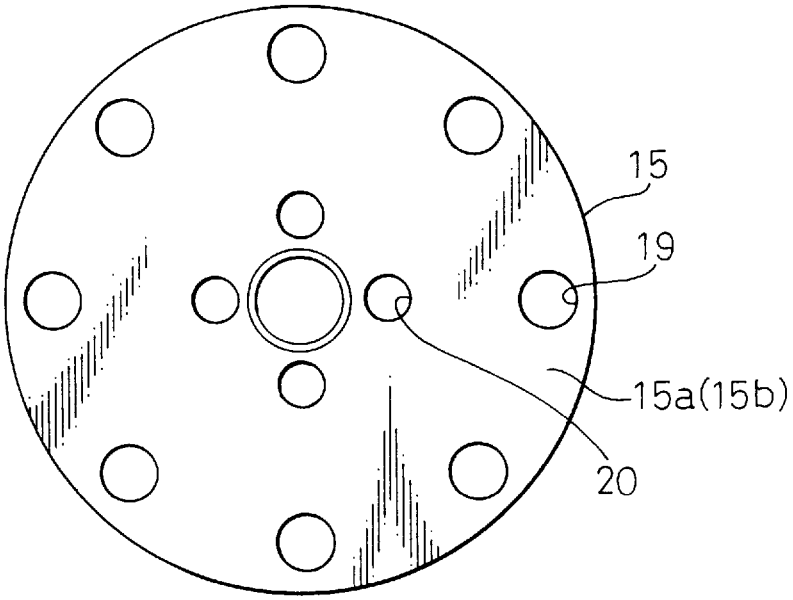
FIG. 2 is an end view of a rotor element incorporated in the heat generator of FIG. 1.
Figure 3:
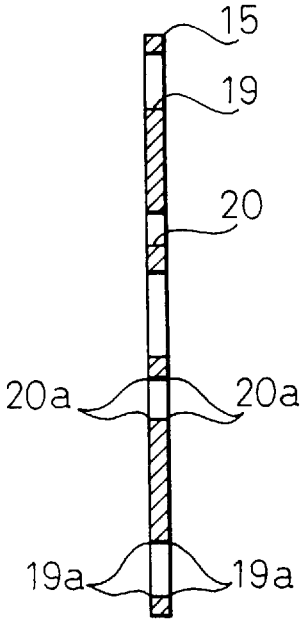
FIG. 3 is a central cross-sectional view of the rotor element of FIG. 2, illustrating the construction of through-holes formed therein.

As best shown in FIGS. 2 and 3, the rotor element 15 is provided with a plurality of (eight) through-holes 19 arranged at a radially outer portion thereof. The through-holes 19 are arranged equiangularly with respect to the axis of rotation thereof, and are formed as round holes having predetermined diameters.

The rotor element 15 is also provided with a plurality of (four) small round through-holes 20 formed in a radially inner portion thereof and arranged at a predetermined angular space about the axis of rotation of the rotor element 15. The through-holes 19 and 20 are provided so as to axially pierce the front and rear end faces 15*a* and 15*b* of the rotor element 15, and permit the viscous fluid within the fluid-tight heat generating chamber 8 to enter therein and to come into contact with the walls of the holes 19 and 20. Thus, these through-holes 19 and 20 are able to have a function equal to expanding a heat generating region formed by the gap of the fluid-tight heat generating chamber 8 when the rotor element is rotated. Namely, heat generation by the viscous fluid within the gap is increased.

It should be noted that the plurality of round through-holes 19 formed in the radially outer portion of the rotor element 15 is arranged in a manner such that the center of each of the through-holes 19 is positioned on a circle defined with respect to the center of the rotor element 15 (i.e., the axis of rotation of the rotor element 15) and having a radius corresponding to ($0.86\times r_0$, $r_0$: the radius of the rotor element 15). The radius of the through-hole 19 is $0.09\times r_0$. It should also be noted that the plurality of small round through-holes 20 formed in the radially inner portion of the rotor element 15 is arranged in a manner such that the center of each of the through-holes 20 is positioned on a circle defined with respect to the center of the rotor element 15 and having a radius corresponding to $0.33\times r_0$. The radius of the through-hole 20 is $0.06\times r_0$.

The through-holes 19 and 20 are not rounded at the corners and have acute edges 19*a* and 20*a* as clearly shown in FIG. 3. These acute edges 19*a* and 20*a* of the through-holes 19 and 20 act so as to provide the viscous fluid having the chain molecular structure with a strong restraint against movement thereof caused by the rotation of the rotor element 15. Therefore, the viscous fluid is subjected to an increased shearing force so as to increase its heat generation.

Figure 4:
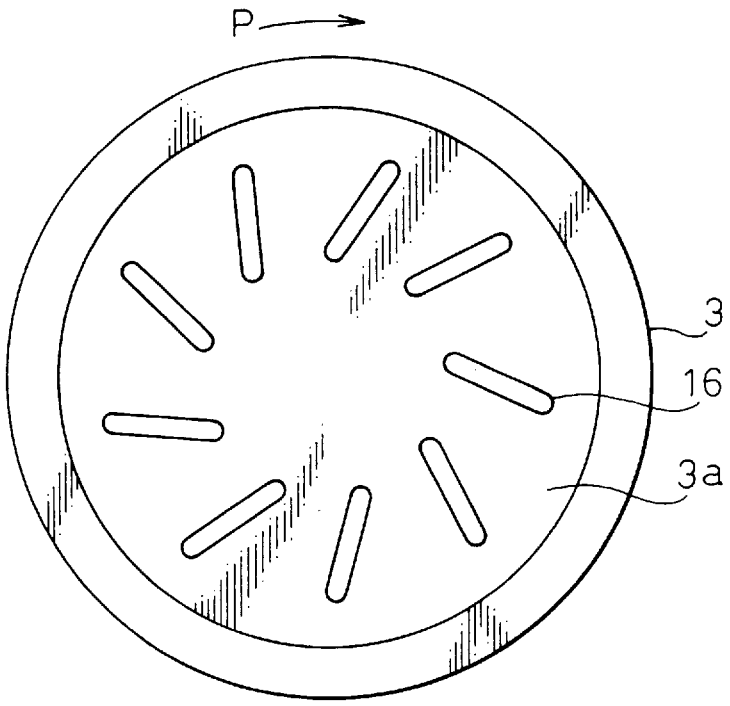
FIG. 4 is an end view of a rear plate element incorporated in the heat generator of FIG. 1.
Figure 5:
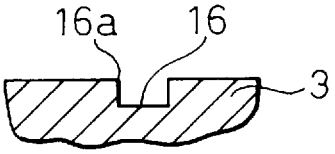
FIG. 5 is a cross-sectional view of a portion of the rear plate element, illustrating the shape of an indentation formed therein.

As shown in FIG. 4, the inner end surface of the rear plate element 3 forming the circular inner wall surface 3*a* of the fluid-tight heat generating chamber 8 is provided with a plurality of (nine) elongate indentations 16 arranged in such a manner that the center lines of the respective elongate indentations 16 are angularly shifted, in a direction corresponding to the rotating direction "P" of the rotor element 15, from radial lines extending from a center of the circular inner wall surface 3*a*. It should be noted that the center of the circular inner wall surface 3*a* of the fluid-tight heat generating chamber 8 is arranged to be in registration with the center of the rotor element 8. The nine elongate indentations 16 are equiangularly spaced from one another with respect to the center of the inner wall surface 3*a* of the heat generating chamber 8. Each of the elongate indentations 16 is provided with acute edges 16*a* as specifically shown in FIG. 5, and an amount of angular shift of the center line of each elongate indentation 16 with respect to the radial line is set to be 30 degrees. The depth of each indentation 16 is predetermined to be $0.007\times r_0$, i.e., the radius of the rotor element 15. It should be understood that the circular inner wall surface 2*a* of the fluid-tight heat generating chamber 8 is also provided with an equal number of elongate indentations 16 arranged to be angularly shifted in the same manner as those of the inner wall surface 3*a* of the fluid-tight heat generating chamber 8. Each of the elongate indentations 16 of the front and rear circular inner wall surfaces 2*a* and 3*a* successively confronts the round through-holes 19 of the rotor element 15 when the rotor element 15 is rotated by the drive shaft 14.

It should be understood that the elongate indentations 16 of the circular inner wall surfaces 2*a* and 3*a* of the fluid-tight heat generating chamber 8 can have the same function as that of the through-holes 19 and 20 of the rotor element 15, i.e., the function of expanding the heat generating region formed by the predetermined gaps of the fluid-tight heat generating chamber 8 when the rotor element 15 is rotated.

In the heat generator of the first embodiment, a vacant region extending between the radially inner region of the rotor element 15 in which the through-holes 20 are formed and the shaft seal device 12 does not contribute to heat generation by the viscous fluid.

When the viscous fluid type heat generator of the first embodiment is incorporated in a heating system of an automobile, and when the drive shaft 14 is driven by an automobile engine via a belt and pulley transmission mechanism, the rotor element 15 is rotated within the cylindrical fluid-tight heat generating chamber 8. Thus, the silicone oil held between the entire outer faces of the rotor element 15 and the inner wall surfaces of the fluid-tight heat generating chamber 8 is subjected to a shearing action by the rotation of the rotor element 15. Therefore, the silicone oil generates heat which is transmitted to a heat exchanging liquid, typically water, flowing through the front and rear heat receiving chambers FW and RW. Thus, the heat is carried to a heating circuit of the heating system to warm an objective area of the automobile such as a passenger cabin.

When the rotor element 15 is rotated within the fluid-tight heat generating chamber 8, the viscous fluid, i.e., the silicone oil held in the predetermined gaps of the fluid-tight heat generating chamber 8 is forced to move with the rotor element 15 in the same direction as the rotating direction of the rotor element 15 because of a high viscosity of the silicone oil, and is subjected to the above-mentioned shearing action to generate heat.

At this stage, since the above-mentioned outer through-holes 19 and the inner through-holes 20 of the rotor element 15 cooperate with the elongated indentations 16 of the front and rear inner wall surfaces 2*a* and 3*a* of the fluid-tight heat generating chamber 8 so as to have a function of expanding the heat generating region formed by the predetermined gaps between the rotor element 15 and the front and rear inner wall surfaces 2*a* and 3*a* in response to the rotation of the rotor element 15, the viscous fluid having a chain molecular structure therein and held in the predetermined gaps is subjected to an increased restraint against a movement thereof caused by the rotating rotor element 15. Therefore, the viscous fluid can be subjected to a strong shearing action and, therefore, generates an increased amount of heat during the rotation of the rotor element 15. More specifically, the plurality of (eight) through-holes 19 having the afore-described predetermined radius (=0.09×$r_0$) are arranged in the outer portion of the rotor element 15 which has a circumferential speed larger than that of the radially inner portion of the rotor element during its rotation. Therefore, the outer through-holes 19 of the rotor element 15 and the elongate indentations 16 of the inner wall surfaces 2*a* and 3*a* of the fluid-tight heat generating chamber 8 can contribute to the application of a strong shearing action to the viscous fluid which is effective for generating a large amount of heat.

Further, the acute edges 19*a* and 20*a* of the outer and inner round through-holes 19 and 20 of the rotor element 15, and the acute edges 16*a* of the angularly shifted elongate indentations 16 of the inner wall surfaces 2*a* and 3*a* of the fluid-tight heat generating chamber 8 can act as hooks and seize the viscous fluid having the chain molecular structure indicating a large viscosity when the viscous fluid is forced to move by the rotation of the rotor element 15. Namely, the viscous fluid within the gaps receives a large restraint against its movement caused by the rotor element 15. Accordingly, a strong shearing action is effectively applied to the viscous fluid, and accordingly, the viscous fluid generates a large amount of heat.

It should be noted that a gaseous component and the air contained or suspended in the viscous fluid can be trapped and held by the through-holes 19 and 20 of the rotor element 15, and the elongate indentations 16 of the inner wall surfaces 2*a* and 3*a* during the rotation of the rotor element 15. Accordingly, the gaseous component and the air are removed from the viscous fluid during the heat generating by the viscous fluid, and as a result, the viscous fluid containing a smaller gaseous component can receive an effective shearing force in response to the rotation of the rotor element 15. Therefore, the heat-generating performance of the viscous fluid of the heat generator is increased.

In the viscous fluid type heat generator of the first embodiment, when the viscous fluid is forced to move together with the rotor element 15 in the rotating direction of the rotor element, the viscous fluid is also urged to move toward a radially outer region of the fluid-tight heat generating chamber 8 by passing through the angularly shifted elongate indentations 16 formed in the inner wall surfaces 2*a* and 3*a* of the fluid-tight heat generating chamber 8. Namely, the viscous fluid is constantly carried from a radially inner region of the fluid-tight heat generating chamber 8 to the radially outer region of the fluid-tight heat generating chamber 8 due to the rotation of the rotor element 15. Specifically, since the elongate indentations 16 have a depth larger than the extent "CL" of the respective gaps, the viscous fluid can easily enter into and pass through these elongate indentations 16 due to a centrifugal force acting on the viscous fluid. Namely, the large depth of the elongate indentations 16 of the inner wall surfaces 2*a* and 3*a* of the fluid-tight heat generating chamber 8 permits the viscous fluid to move by the effect of the centrifugal force acting on the fluid rather than that of the known Weissenberg Effect acting on the viscous fluid. Therefore, when the rotor element 15 is rotated, the viscous fluid is effectively moved from the radially inner region to the radially outer region of the fluid-tight heat generating chamber 8. In the radially outer region of the fluid-tight heat generating chamber 8, since the radially outer portion of the rotor element 15 has a circumferential speed larger than the radially inner portion of the element 15 during the rotation thereof, the radially outer portion of the rotor element 15 can apply a large shearing action to the viscous fluid and therefore, an amount of heat generation by the viscous fluid can be increased.

It will be understood from the foregoing description that in the viscous fluid type heat generator according to the first embodiment, since the cooperation of the through-holes 19 and 20 of the rotor element 15 with the elongate indentations 16 of the inner wall surfaces 2*a* and 3*a* of the fluid-tight heat generating chamber 8 can expand the heat generating region formed by the gaps of the fluid-tight heat generating chamber 8, the heat generator can effectively increase the amount of heat generation in the viscous fluid, without increasing the entire size of the heat generator.

Further, in the viscous fluid type heat generator of the first embodiment, the outer and inner round through-holes 19 and 20 of the rotor element 15 permit the viscous fluid in the gaps to flow through these through-holes 19 and 20, particularly through the through-holes 20. Thus, pressures of the viscous fluid prevailing in the gaps on both sides of the rotor element 15 can be constantly equal to one another. Thus, the amount of the viscous fluid held in the gaps on both sides of the rotor element 15 can be equal. Therefore, a reduction in the heat generation by the viscous fluid due to unequal distribution of the viscous fluid in the fluid-tight heat generating chamber 8 on both sides of the rotor element 15 can be avoided. At this stage, if the rotor element 15 is axially shiftably and rotationally fixedly mounted on the drive shaft 14 by, e.g., a spline engagement between the rotor element 15 and the drive shaft 14, the above-mentioned equal pressure of the viscous fluid on both sides of the rotor element 15 is effective for positioning the rotor element 15 at a suitable position within the fluid-tight heat generating chamber 8.

In the heat generator of the first embodiment, nine elongate and angularly shifted indentations 16 are formed in each of the front and rear inner wall surfaces 2*a* and 3*a* of the fluid-tight heat generating chamber 8, and eight outer round through-holes 19 are formed in the radially outer portion of the rotor element 15 so as to confront the elongate indentations 16 during the rotation of the rotor element 15. Namely, the angular space between the two neighboring through-holes 19 is different from that of the two neighboring elongate indentations 16. Therefore, all of the through-holes 19 of the rotor element 15 do not simultaneously come into registration with the elongate indentations 16 on both inner wall surfaces 2*a* and 3*a* during the rotation of the rotor element 15. Accordingly, during the rotation of the rotor element 15, a change in torque of the rotor element 15 caused by the provision of the through-holes 19 and that caused by the provision of the elongate indentations 16 can mutually cancel out, and therefore, generation of vibration and noise during the rotation of the rotor element 15 can be suppressed.

Furthermore, in the viscous fluid type heat generator of the first embodiment, the outer through-holes 19 of the rotor element 15 can operate so as to carry the viscous fluid, which flows down to a lower region of the heat generating chamber 8 due to its gravity during the stopping of the operation of the heat generator, toward an upper region of the fluid-tight heat generating chamber 8 when the rotor element 15 is rotated by the drive shaft 14. Namely, the through-holes 19 provided in a portion of the rotor element 15 submerged in the viscous fluid in the lower region of the fluid-tight fluid-tight heat generating chamber 8 carry the viscous fluid toward the upper region in the fluid-tight heat generating chamber 8 in response to the rotation of the rotor element 15. Therefore, the viscous fluid can be quickly distributed into all of the regions in the gaps of the fluid-tight heat generating chamber 8 immediately after the starting of the heat generator, and accordingly, the heat generator can quickly start the heat generating operation.

Figure 6:
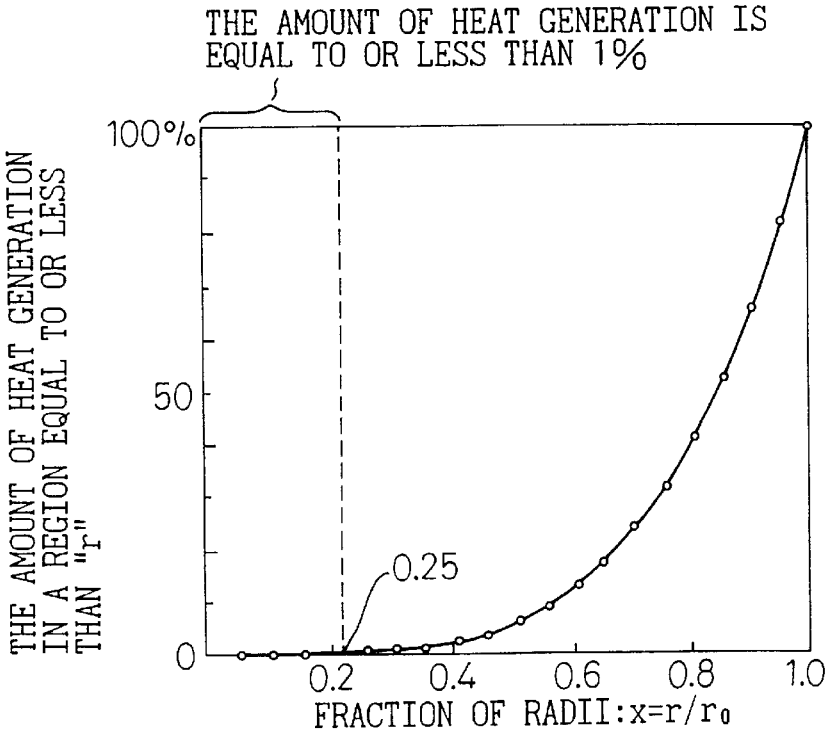
FIG. 6 is a graph indicating a relationship between an amount of heat generation in a heat generating region enclosed by a circle having a radius "r" and a fraction of the radius "r" and a predetermined radius "$r_0$" of the rotor element of FIG. 2.

FIG. 6 is a graph indicating a theoretical relationship between the amount of heat generation in a given region of the gaps, enclosed by a circle having a radius "r" equal to or less than the radius "$r_0$" of the rotor element 15 with respect to the center of the fluid-tight heat generating chamber 8, and a fraction of radii "$X=r/r_0$" in the case where the rotor element 15 is provided with no through-holes 19 and 20. That is to say, the ordinate indicates the amount of heat generation within the given region of the gaps having a radius "r", and the abscissa indicates the fraction "X". Thus, when X=1.0, the given region of the gaps is a region enclosed by a circle having a radius "r" equal to "$r_0$". Namely, the given region means the entire region of the gaps. Therefore, the amount of heat generation becomes 100%, i.e., an entire amount of heat generation by the heat generator.

It will be understood from the graph of FIG. 6 that when the radius "r" of the given region is less than 0.25 $r_0$ ($X<0.25$), the ratio of the amount of heat generation with respect to the entire amount of heat generation is equal to or less than 1%, because of an extremely small shearing action applied to the viscous fluid by a portion of the rotor element 15 having a radius equal to or less than 0.25 $r_0$.

Taking this into consideration, it can be understood that the through-holes 19 and 20 should not be arranged in a region having a radius less than 0.25 $r_0$. It is obvious that an arrangement of the through-holes 19 and 20 in this region does not contribute to an increase in the amount of heat generation by the viscous fluid. When the graph of FIG. 6 is considered, it can be understood that the through-holes 19 and 20 should be arranged in such a manner that the center of each of the through-holes 19 should preferably be located on a circle having a radius equal to or larger than 0.3 $r_0$ which corresponds to the above-mentioned radius of 0.25 $r_0$ plus the minimum radius of 0.05 $r_0$ of the through-hole 19 and 20.

Figure 7:
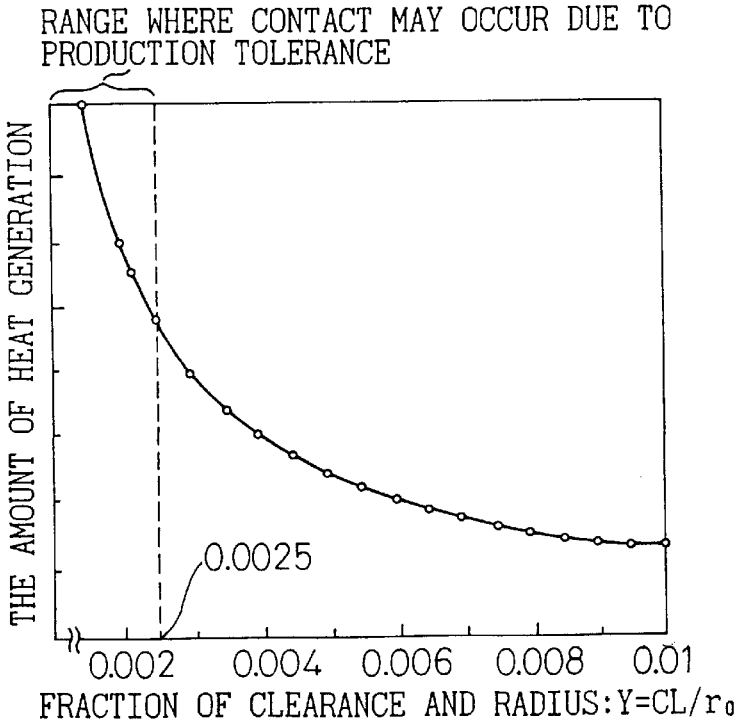
FIG. 7 is a graph indicating a relationship between an amount of heat generation in a fluid-tight heat generating chamber having a gap "CL" and a fraction of the gap "CL" and a predetermined radius "$r_0$" of the rotor element of FIG. 2 with regard to the viscous fluid type heat generator of FIG. 1.

The graph of FIG. 7 indicates a theoretical relationship between the amount of heat generation (the ordinate), and the extent "CL" of the afore-mentioned gaps of the fluid-tight heat generating chamber 8 in the case where the radius of the rotor element 15 is "$r_0$" (the abscissa). It should be noted that in FIG. 7, the abscissa indicates a fraction "Y" of the extent "CL" and the radius "$r_0$" of the rotor element, i.e., $Y=CL/r_0$.

From the graph of FIG. 7, it is understood that the heat generation can be theoretically increased by reducing the extent of the gaps between the rotor element 15 and the inner wall surface 2*a* and 3*a* of the fluid-tight heat generating chamber 8. Nevertheless, when the viscous fluid type heat generator is practically manufactured and assembled, the production tolerance of the rotor element 15 must be taken into consideration. Namely, when the fraction "Y" (="CL"/"$r_0$") is set to be smaller than 0.0025, the front and rear end faces 15*a* and 15*b* of the rotor element 15 might come into contact with the front and rear inner wall surfaces 2*a* and 3*a* of the fluid-tight heat generating chamber 8 due to the production tolerance of the rotor element 15. Therefore, the extent "CL" of the gaps of the fluid-tight heat generating chamber 8 should preferably be determined to be equal to or larger than 0.0025 $r_0$. Therefore, in the first embodiment of the present invention, as stated before, the extent CL of the gaps on both sides of the rotor element 15 within the fluid-tight heat generating chamber 8 is determined to be CL="y"×"$r_0$"=0.003 $r_0$.

It should be noted that the extent "CL" of the gaps of the fluid-tight heat generating chamber 8 should preferably be equal to or less than 0.0045 $r_0$, and further preferably be equal to or less than 0.0035 $r_0$. Even when the extent "CL" of the gaps is determined to be 0.0045 $r_0$, it was experimentally detected that the amount of heat generation by the viscous fluid can be larger than 67% of the amount of heat generation obtained by the heat generator of the first embodiment in which "CL" is determined to be 0.003 $r_0$, and accordingly, the value 0.0045 $r_0$ or less for the extent of the gaps can be practical from the viewpoint of obtaining heat sufficient for being used in an automobile heating system.

Further, when the total area occupied by the through-holes 19 and 20 of the rotor element 15 with respect to the remaining area of the front and rear end faces 15*a* and 15*b* of the rotor element 15 is excessively large, the viscous fluid will fail to be subjected to a sufficient friction between the end faces 15*a* and 15*b* of the rotor element 15 and the inner wall surfaces 2*a* and 3*a* of the fluid-tight heat generating chamber 8 during the rotation of the rotor element 15, and as a result, even if the viscous fluid can be subjected to a strong shearing action due to the provision of the through-holes 19 and 20, the heat generating performance of the viscous fluid must be reduced. Similarly, when the total area occupied by the elongate angularly shifted indentations 16 with respect to the remaining area of the inner wall surfaces 2*a* and 3*a* of the fluid-tight heat generating chamber 8 is excessively large, the viscous fluid will again fail to be subjected to a sufficient friction between the end faces 15*a* and 15*b* of the rotor element 15 and the inner wall surfaces 2*a* and 3*a* of the fluid-tight heat generating chamber 8 during the rotation of the rotor element 15, and as a result, the heat generating performance of the viscous fluid must be reduced even if the provision of the elongate indentations 16 contributes to an increase in the shearing action applied to the viscous fluid.

Figure 8:
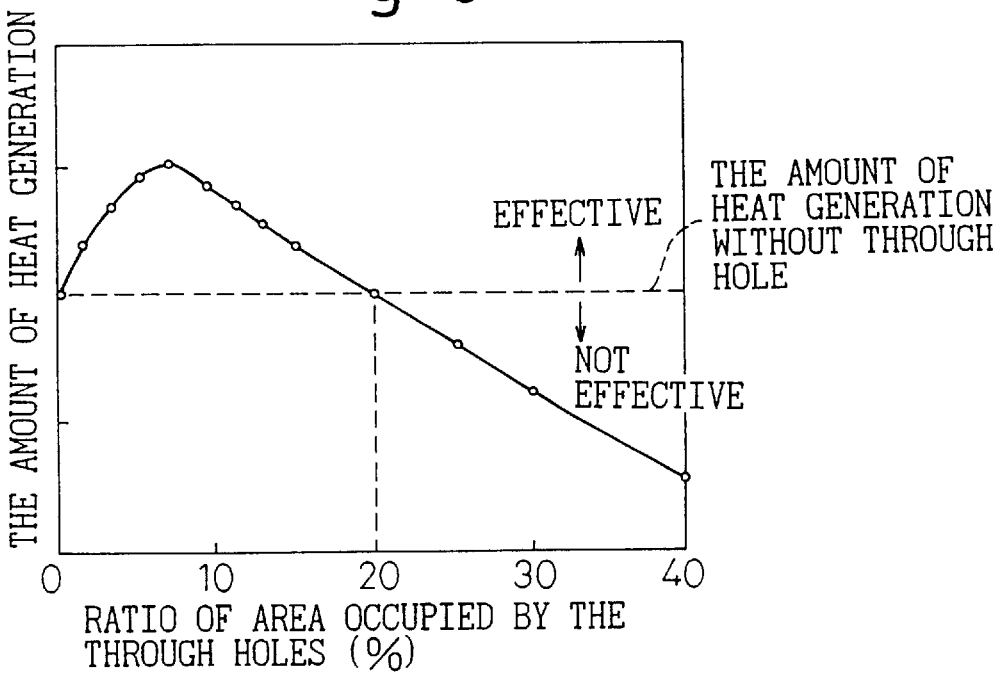
FIG. 8 is a graph indicating a relationship between an amount of heat generation in a fluid-tight heat generating chamber and a ratio of area occupied by the through-holes with respect to the entire area of the rotor element.

The graph of FIG. 8 indicates a relationship between the amount of heat generation by the viscous fluid (the ordinate), and the ratio of an area occupied by the round through-holes 19 and 20 piercing the opposite end faces 15*a* and 15*b* of the rotor element 15 and the area of one of the end faces 15*a* and 15*b* with no through-holes (the abscissa). The graph of FIG. 8 was obtained from an experiment conducted by the present inventors.

From the graph, it can be understood that when the ratio of the area occupied by the round through-holes 19 and 20 is more than 20%, the amount of heat generation by the viscous fluid with the rotor element 15 having the through-holes is smaller than that with the rotor element 15 having no through-holes. Namely, when the ratio of the area occupied by the round through-holes 19 and 20 is more than 20%, the provision of the through-holes 19 and 20 in the rotor element 15 is not effective for obtaining an increase in the amount of heat generation by the viscous fluid. On the other hand, when the ratio of the area occupied by the through-holes 19 and 20 is determined to be a value between 0% and 20%, the amount of heat generation by the viscous fluid with the rotor element 15 having the through-holes 19 and 20 is effectively increased. Therefore, the ratio of the area occupied by the through-holes 19 and 20 with respect to the area of the end face 15*a* or 15*b* should preferably be determined to be a value less than 20%. Further, when this ratio of the area occupied by the through-holes 19 and 20 is taken into consideration, the radius of each through-hole 19 should preferably be set at a value between 0.05×$r_0$ through 0.15×$r_0$. Further, the total area of the elongate indentations 16 formed in each of the front and rear inner wall surfaces 2*a* and 3*a* should preferably be determined to be equal to or less than 20% of the area of one of the end faces 15*a* and 15*b* of the rotor element 15.

Because the circumferential speed of the radially inner portion of the rotor element 15 is smaller than that of the radially outer portion of the rotor element 15, it will be easy for the viscous fluid to enter the through-holes 20. The round inner through-holes 20 of the rotor element 15 are provided mainly for permitting the viscous fluid to pass therethrough from one side to the other of the rotor element 15 so that the amount of the viscous fluid held in the gaps of the fluid-tight heat generating chamber 8 on each side of the rotor element 15 is kept equal to one another. To this end, the center of each of the through-holes 20 should preferably be located in a region enclosed by a circle having a radius of 0.5 $r_0$ with respect to the center of the rotor element 15, and the radius of the through-hole 20 should preferably be a value between 0.05 $r_0$ through 0.15 $r_0$.

Figure 9:
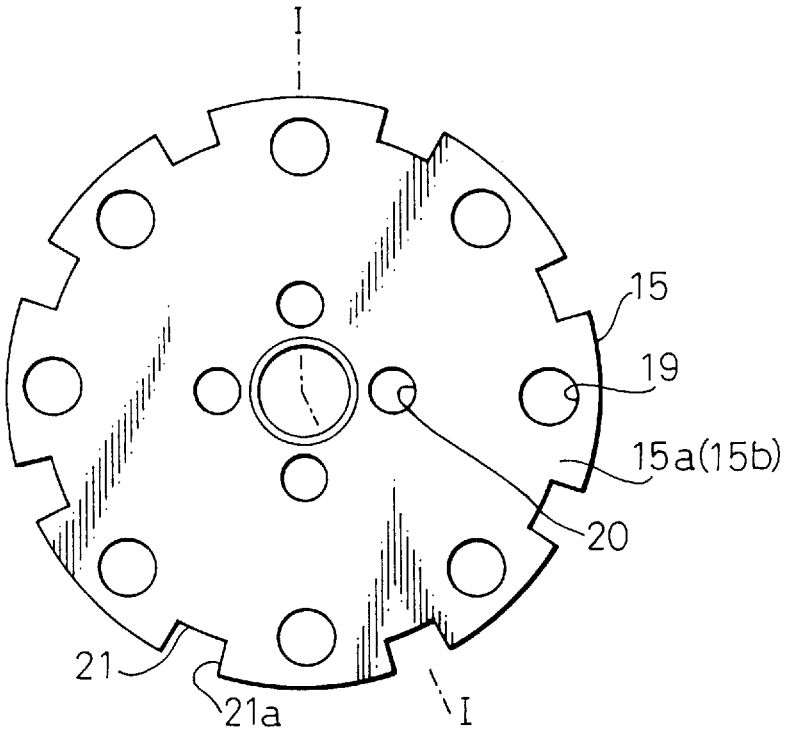
FIG. 9 is an end view of a rotor element incorporated in a viscous fluid type heat generator according to a second embodiment of the present invention.
Figure 10:
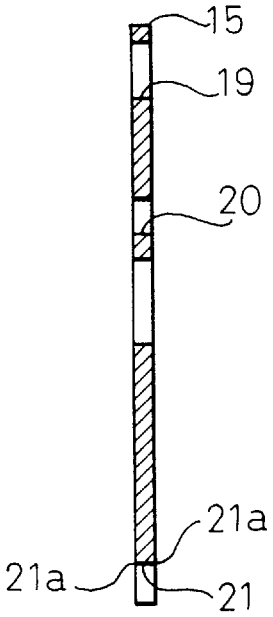
FIG. 10 is a cross-sectional view of the rotor element taken along the line I—I of FIG. 9.

FIGS. 9 and 10 illustrate a rotor element to be incorporated in a viscous fluid type heat generator according to a second embodiment.

In FIGS. 9 and 10, the rotor element 15 is provided with a plurality of (eight) cutaway portions 21 having the shape of substantially square cuts formed in the outer circumference thereof in addition to the through-holes 19 and 20 similar to those of the rotor element 15 of the first embodiment. The cutaway portions 21 are equiangularly arranged around the center of the rotor element 15, and have acute side edges 21*a*. It should be understood that the viscous fluid type heat generator of the second embodiment is provided with the same construction as that of the heat generator of the first embodiment except for the rotor element 15 with the cutaway portions 21. Therefore, the heat generator of the second embodiment having the rotor element 15 with the cutaway portions 21 can exhibit an increased heat generating performance similar to that of the afore-described heat generator of the first embodiment without increasing the physical size of the heat generator.

The cutaway portions 21 of the rotor element 15 can act so as to expand a heat generating region formed by the fluid-tight gaps of the fluid-tight heat generating chamber 8. Further, the cutaway portions 21 having the acute edges 21*a* can provide the viscous fluid with an additional restraint against the movement of the viscous fluid caused by the rotation of the rotor element 15 when the latter is rotated by the drive shaft 14. Therefore, the viscous fluid held in the heat generating region formed by the gaps can be subjected to additionally strong shearing action, and accordingly, can further increase an amount of heat generation compared with the heat generator of the first embodiment. It should further be noted that the cutaway portions 21 formed in the outer circumference of the rotor element 15 can have a function equivalent to expanding a heat generating region formed by an annular gap provided between the outer circumference of the rotor element 15 and the inner circular wall surface of the fluid-tight heat generating chamber 8 during the rotation of the rotor element 15. Namely, the cutaway portions 21 of the rotor element 15 provide the molecules of the viscous fluid having a chain molecular structure therein with a restraint against its movement caused by the rotational movement of the circumference of the rotor element 15, and the viscous fluid in the annular gap of the fluid-tight heat generating chamber 8 is in turn subjected to a strong shearing action so that an amount of heat generation can be increased.

Further, the cutaway portions 21 of the rotor element 15 can operate so as to carry and distribute a portion of the viscous fluid held in the lower portion of the fluid-tight heat generating chamber 8 to many portions of the annular gap when the rotor element 15 starts to rotate by the driving of the drive shaft 14. Thus, the heat generator of the second embodiment can quickly start its heat generating operation when it is driven by an external drive source such as an automobile engine after the stopping of the operation of the heat generator.

It should be appreciated that the shapes of the inner and outer through-holes 19 and 20 of the rotor element 15 are not limited to the round shape shown in FIG. 9, and may be a square shape or a triangular shape as required. Further, the angularly shifted elongate indentations 16 formed in the front and rear inner wall surfaces 2*a* and 3*a* of the cylindrical fluid-tight heat generating chamber 8 may be replaced with differently shaped elongate indentations if they are arranged to extend in a non-circumferential direction with respect to the center of the inner wall surfaces 2*a* and 3*a*. Therefore, for example, a plurality of elongate radial indentations may be arranged in each of the front and rear inner wall surfaces 2*a* and 3*a* of the heat generating chamber 8 instead of the angularly shifted elongate indentations 16.

Figure 11:
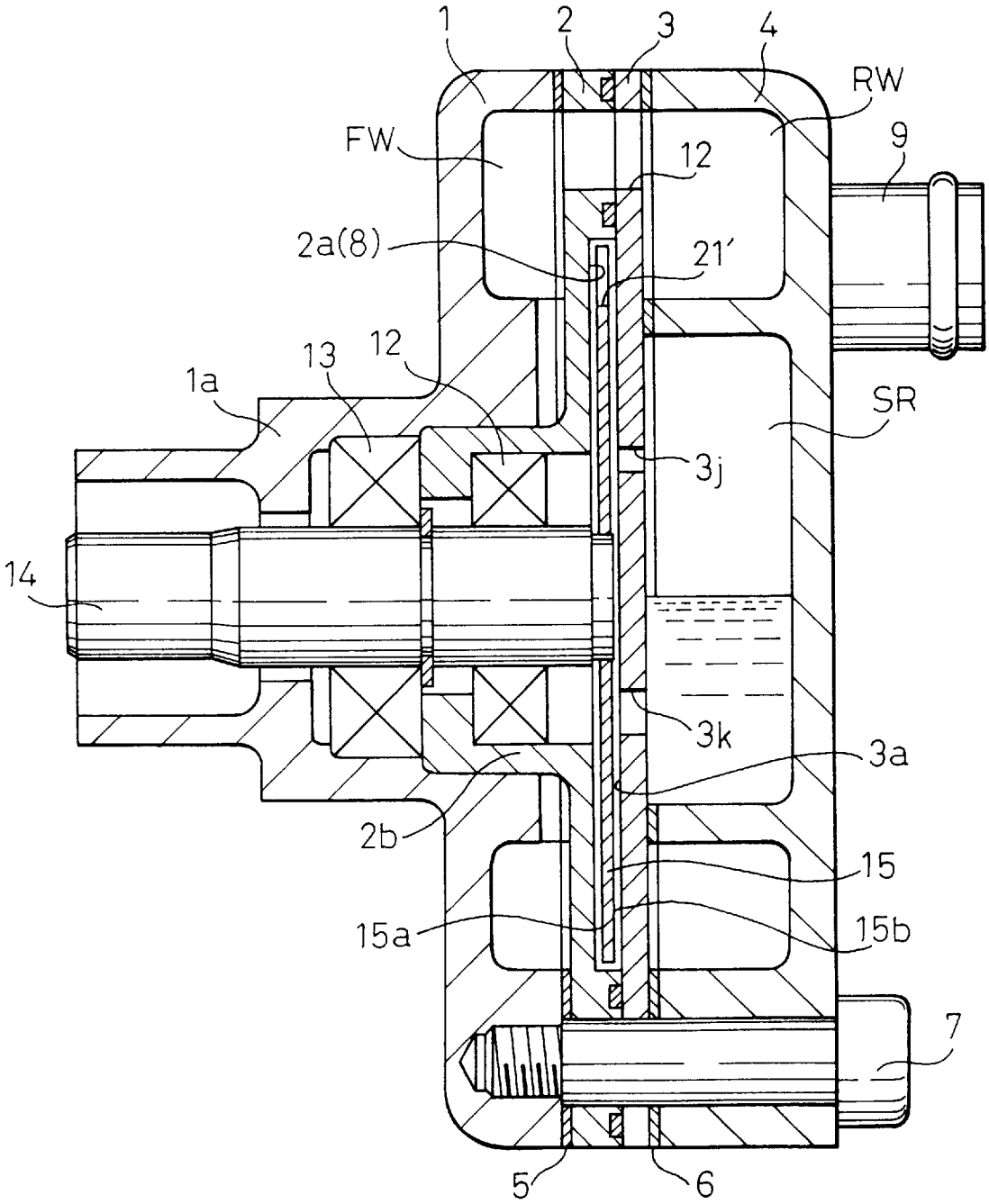
FIG. 11 is a longitudinal cross-sectional view of a viscous fluid type heat generator according to a third embodiment of the present invention.
Figure 12:
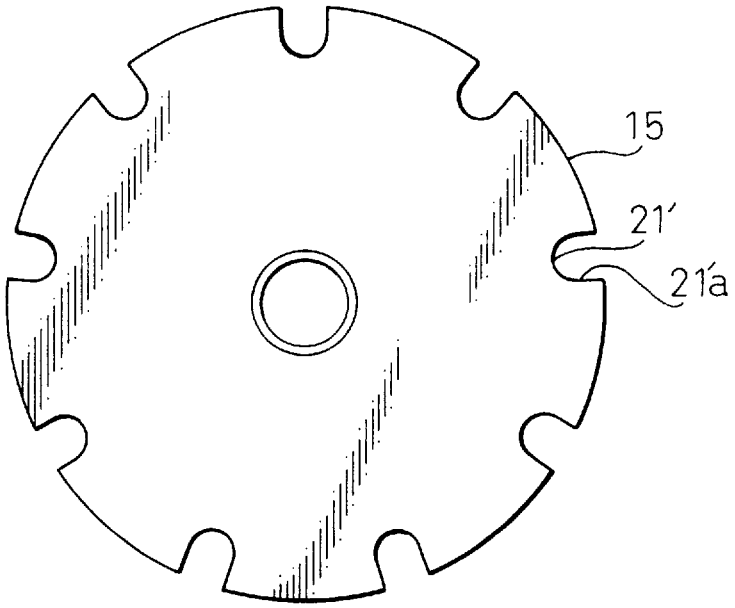
FIG. 12 is an end view of the rotor element incorporated in the heat generator of FIG. 11.
Figure 13:
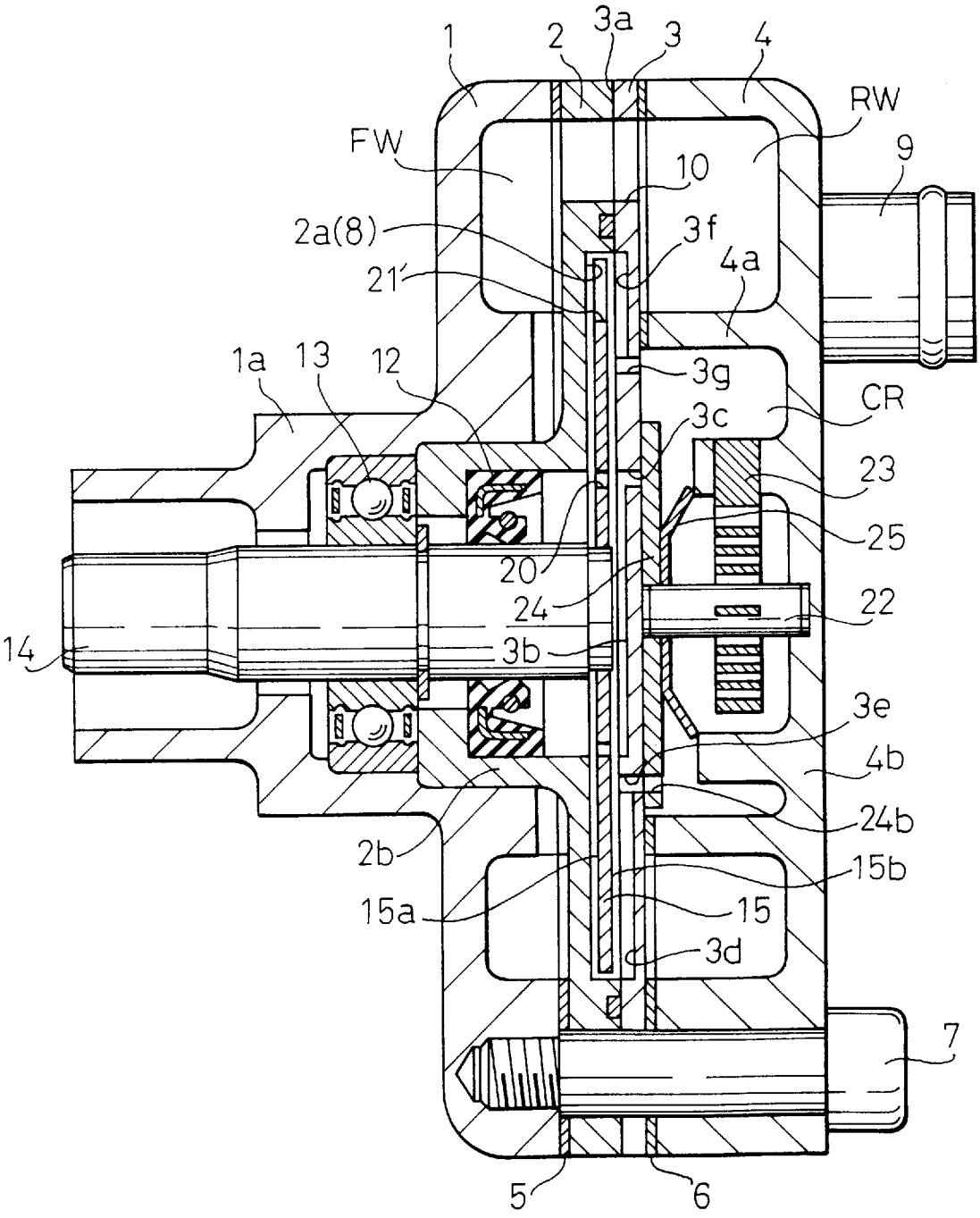
FIG. 13 is a longitudinal cross-sectional view of a viscous fluid type heat generator according to a fourth embodiment of the present invention.

FIGS. 11 and 12 illustrate a viscous fluid type heat generator according to a third embodiment of the present invention.

From the illustration of FIG. 11, it will be understood that the viscous fluid type heat generator of this embodiment is different from the heat generator of the first embodiment of FIG. 1 in that the rear housing body 4 is provided with a centrally arranged fluid storing chamber SR for storing the viscous fluid. The fluid storing chamber SR of the rear housing body 4 fluidly communicates with the fluid-tight heat generating chamber 8 via a through hole 3*j* formed in the rear plate element 3 at a position above the center of the same element 3, and a larger through hole 3*k* formed in the rear plate element 3 at a position below the center of the same element 3. The smaller through hole 3*j* is provided for withdrawing the viscous fluid from the fluid-tight heat generating chamber 8 into the fluid storing chamber SR, and the larger through hole 3*k* is provided for supplying the viscous fluid from the fluid storing chamber SR to the fluid-tight heat generating chamber 8.

The heat generator of the third embodiment is further different from that of the first embodiment in that as clearly shown in FIG. 12, the rotor element 15 is provided with a plurality of (nine) cutaway portions 21' formed in the outer circumference thereof and equidistantly arranged. The cutaway portion 21' has the shape of a radial cut opening outwardly and having a round bottom and acute side edges 21'*a*. The heat generator of the third embodiment is still further different from that of the first embodiment in that the inner wall surfaces 2*a* and 3*a* of the fluid-tight heat generating chamber 8 confronting the end faces 15*a* and 15*b* of the rotor element 15 are provided with no angularly shifted elongate indentation formed therein.

The heat generator of the third embodiment is characterized in that the cutaway portions 21' of the rotor element 15 similar to the cutaway portions 21 of the second embodiment can have an ability of expanding a heat generating region formed by an annular gap provided between the outer circumference of the rotor element 15 and the inner circular wall surface of the fluid-tight heat generating chamber 8 during the rotation of the rotor element 15. Namely, the cutaway portions 21' of the rotor element 15 provide the molecules of the viscous fluid having a chain molecular structure therein with a restraint against its movement caused by the rotational movement of the outer circumference of the rotor element 15, and accordingly, the viscous fluid in the annular gap of the fluid-tight heat generating chamber 8 can be subjected to a strong shearing action so as to increase an amount of heat generation.

Further, the cutaway portions 21' of the rotor element 15 can operate so as to carry and distribute a portion of the viscous fluid held in the lower portion of the fluid-tight heat generating chamber 8 to many portions of the annular gap when the rotor element 15 is rotated by the drive shaft 14 after the operation of the viscous fluid type heat generator is stopped for a while. Thus, the heat generator of the third embodiment can start its heat generating operation immediately when the drive shaft 14 is rotationally driven by an external drive source such as an automobile engine.

Since the viscous fluid type heat generator of the third embodiment is provided with the fluid storing chamber SR, the amount of viscous fluid stored within the interior of the heat generator is larger than that stored within the interior of the heat generator having no fluid storing chamber. Accordingly, when the operation of the heat generator stops for a relatively long time, a large amount of gaseous component suspended in the viscous fluid oozes out of the viscous fluid and fills an upper portion of the heat chamber 8 and the fluid storing chamber SR. Therefore, during the stopping of the heat generator, the flow of the viscous fluid from the upper portion toward the lower portion of the fluid-tight heat generating chamber 8 due to its gravity is further promoted by the pressure of the gaseous component filling the upper portion of the fluid-tight heat generating chamber 8. Nevertheless, due to the provision of the cutaway portions 21', the rotor element 15 can scoop the viscous fluid in the lower portion and distribute it to various portions in the fluid-tight heat generating chamber 8 including the upper portion, as soon as the heat generator starts its operation to rotate the rotor element 15. Thus, the quick start of the generation of a large amount of heat by the viscous fluid can be ensured by the rotor element 15 with the cutaway portions 21', according to the third embodiment.

Further, in the viscous fluid type heat generator according to the embodiment of FIG. 11, the fluid storing chamber SR can store a predetermined volume of viscous fluid which is larger than the overall capacity of the fluid holding space in the fluid-tight heat generating chamber 8, and it is not needed to accurately and precisely determine a filling amount of viscous fluid when it is initially filled into the fluid-tight heat generating chamber 8.

Since the fluid storing chamber SR of the rear housing body 4 communicates with the fluid-tight heat generating chamber 8 via the withdrawing through hole 3*j* and the supply through hole 3*k*, the viscous fluid collected in the radially inner region of the fluid-tight heat generating chamber 8 by the Weissenberg Effect and by the movement of the gaseous component can be withdrawn from the fluid-tight heat generating chamber 8 into the fluid storing chamber SR through the fluid withdrawing through hole 3*j*. Further, it is possible to supply the viscous fluid from the fluid storing chamber SR to the fluid-tight heat generating chamber 8 through the fluid supply through hole 3*k*. Thus, in the viscous fluid type heat generator of the third embodiment, replacement of the viscous fluid in the fluid-tight heat generating chamber 8 by that in the fluid storing chamber SR can be carried out, and a suitable amount of viscous fluid can be supplied into the fluid-tight heat generating chamber 8 so as to allow a sufficient amount of heat to be generated in the fluid-tight heat generating chamber 8.

Further, since the viscous fluid within the fluid-tight heat generating chamber 8 is thermally expanded, a part of the viscous fluid can flow into, and be received by, the fluid storing chamber SR, a high fluid pressure is not applied to the shaft sealing device 12. Therefore, a good fluid sealing performance of the shaft sealing device 12 can be maintained over a long operation life.

Still further, since the fluid storing chamber SR can be store the viscous liquid whose volume is larger than the capacity of the space within the fluid-tight heat generating chamber 8, and since the viscous fluid held within the fluid-tight heat generating chamber 8 can be constantly replaced and refreshed by the viscous fluid in the fluid storing chamber SR, the same viscous fluid is not always subjected to the shearing action within the fluid-tight heat generating chamber 8, and accordingly, the thermal degradation of the viscous fluid, due to constant heat generation, can be suppressed.

FIGS. 13 through 16 illustrate a viscous fluid type heat generator according to a fourth embodiment.

The viscous fluid type heat generator of the fourth embodiment has a number of differences in its construction from that of the heat generator of the first embodiment. Namely, the inner wall surface 3*a* of the fluid-tight heat generating chamber 8 defined by the inner surface of the rear plate element 3 is centrally provided with a fluid collecting recess 3*b* formed therein to communicate with a central portion of the fluid-tight heat generating chamber 8 arranged on the rear side of the rotor element 15 and with a first withdrawing passageway 3*c* through-bored in the rear plate element 3 arranged at an outer portion of the fluid collecting recess 3*b*. Further, the rear plate element 3 is also provided with a radial fluid supply channel 3*d* formed therein to communicate with a lower portion of the fluid-tight heat generating chamber 8 on the rear side of the rotor element 15 and with a first fluid supply passageway 3*e* through-bored in the rear plate element 3. The radial fluid supply channel 3*d* has a width and a depth sufficient for introducing the viscous fluid, i.e., a silicone oil, into the fluid-tight heat generating chamber 8 therethrough, and via the fluid supply passageway 3*e* which has a large diameter allowing the viscous fluid to flow therethrough. Thus, the diameter of the fluid supply passageway 3*e* is larger than that of the fluid withdrawing passageway 3*c*. It should be appreciated that the radial fluid supply channel 3*d* is formed to extend to the lowermost end of the fluid-tight heat generating chamber 8 beyond the outermost edge of the rotor element 15.

Further, the inner wall surface 3*a* of the fluid-tight heat generating chamber 8 according to the fourth embodiment is provided with a gas channel 3*f* extending radially and axially communicating with an upper portion of the fluid-tight heat generating chamber 8 and with a gas passageway 3*g* through-bored in the rear plate element 3. It should be noted that the radial gas channel 3*f* and the gas passageway 3*g* form a gas withdrawing passage provided between the upper portion of the fluid-tight heat generating chamber 8 and a later-described heat generation control chamber CR.

The rear housing body 4 is provided with a first inner rib 4*a* extending annularly around the center of the rear housing 4 and abutting against the gasket 6 arranged between the rear end face of the rear plate element 3 and the rear housing body 4. The first inner rib 4*a* of the rear housing body 4 and an outer flange portion of the rear housing body 4 cooperate with the rear end face of the rear plate element 3 to define an annular heat receiving chamber RW arranged adjacent to a rear portion of the fluid-tight heat generating chamber 8. The rear housing body 4 also defines a heat generation control chamber CR between a central portion of the inner wall of the rear housing body 4 and a central portion of the rear plate element 3 and enclosed by the first inner rib 4*a*. The heat generation control chamber CR communicates with the first withdrawing passageway 3*c*, the first supply passageway 3*e*, and the gas passageway 3*g*.

The rear housing body 4 is further provided with an annular second inner rib 4*b* arranged radially inside the first rib 4*a*. The second annular rib 4*b* is formed in the heat generation control chamber CR and surrounds a valve shaft 22 rotatably held in a central position of the inner wall of the rear housing body 4. The valve shaft 22 is formed as an axial element which projects from the inner wall of the rear housing body 4 into the central portion of the heat generation control chamber CR. A thermo-sensitive actuator including a bimetal-coil-spring 23 having an outer end fixed to a portion of the second inner rib 4*b* and an inner end of the bimetal-coil-spring 23 is fixed to a central position of the rotatable valve shaft 22. The bimetal-coil-spring 23 is provided so as to spirally move from a predetermined position set for a predetermined temperature which is set as a reference temperature for heating an objective heated area such as a passenger compartment of an automobile, in response to a change in the temperature thereof from the predetermined temperature. The movement of the bimetal-coil-spring 23 causes a rotation of the valve shaft 22 to which a single disc-like rotary valve 24, functioning as first and second valve means, is secured so as to rotate with the valve shaft 22. The rotary valve 24 is urged toward the rear end face of the rear plate element 3 by a disc spring 25 seated against an annular end of the annular second rib 4*b*, so that the rotary valve 24 normally closes the first fluid withdrawing passageway 3*c* and the first fluid supply passageway 3*e* within the heat generation control chamber CR.

Figure 14:
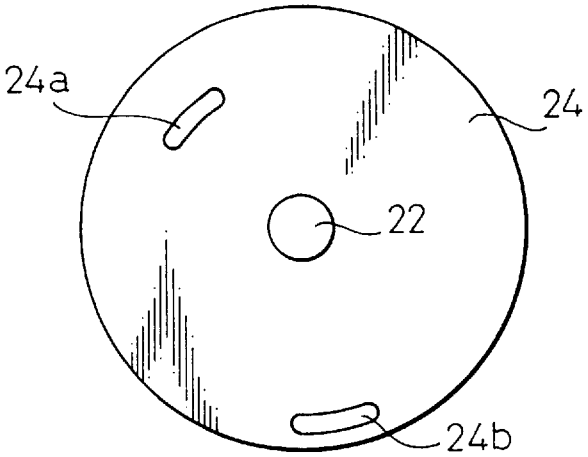
FIG. 14 is an end view of a rotary valve incorporated in the heat generator of the fourth embodiment.

As best shown in FIG. 14, the disc-like rotary valve 24 is provided with curved elongated apertures through-bored as a second fluid withdrawing passageway 24*a*, and a second fluid supply passageway 24*b*, respectively. The second fluid withdrawing passageway 24*a* is arranged to be in communication with the first fluid withdrawing passageway 3*c* of the rear plate element 3 in response to the rotation of the rotary valve 24. Similarly, the second fluid supply passageway 24*b* is arranged to be in communication with the first fluid supply passageway 3*e* of the rear plate element 3 in response to the rotation of the rotary valve 24. The second fluid supply passageway 24*b* has a width thereof determined to be slightly larger than that of the second fluid withdrawing passageway 24*a* so that the viscous fluid is apt to be supplied from the heat generation control chamber CR to the fluid-tight heat generating chamber 8.

It should be noted that the fluid collecting recess 3*b*, the first fluid withdrawing passageway 3*c* and the second fluid withdrawing passageway 24*a* form a fluid withdrawing passage from the fluid-tight heat generating chamber 8 to the heat generation control chamber CR, and that the fluid supply channel 3*d*, the first fluid supply passageway 3*e*, and the second fluid supply passageway 24*b* form a fluid supply passage from the heat generation control chamber CR to the fluid-tight heat generating chamber 8. Namely, the viscous fluid type heat generator of the fourth embodiment has a controlling function to adjustably change an amount of the viscous fluid held in the fluid-tight heat generating chamber by using the fluid withdrawing passageway 3*b* and the fluid supply passageway 3*c* which are opened and closed by the rotation of the rotary valve 24 controlled by the thermo-sensitive actuator. Therefore, the viscous fluid type heat generator of the fourth embodiment can adjustably change an amount of heat generation by the viscous fluid without an any appreciable increase in the axial length of the heat generator.

Figure 17:
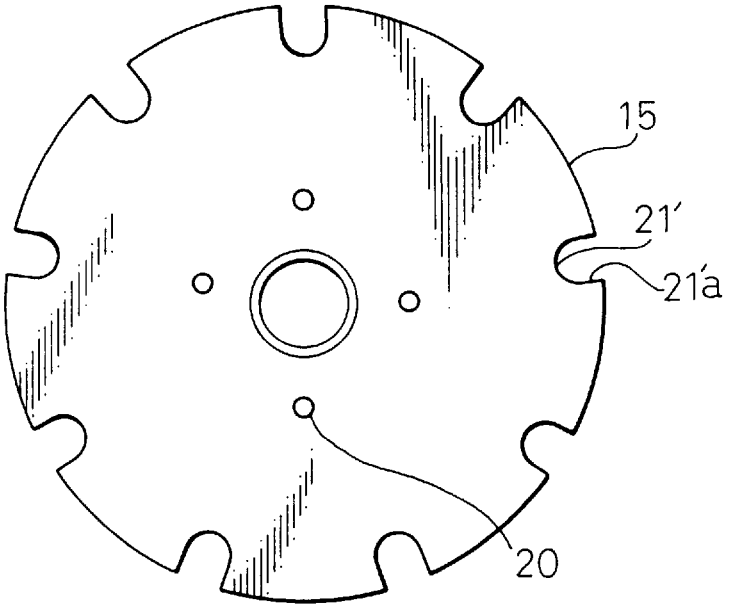
FIG. 17 is an end view of a rotor element incorporated in the heat generator of the fourth embodiment; and, FIG. 18 is a time chart of the operation of the rotary valve, illustrating a relationship between the rotating angle of the rotary valve from a predetermined position "A" and the opening and closing positions of the withdrawing and supply passageways formed in the rear plate element.

As clearly shown in FIG. 17, the rotor element 15 incorporated in the heat generator of the fourth embodiment is provided with a plurality of (nine) cutaway portions 21' formed in the outer circumference thereof and equidistantly arranged. The cutaway portion 21' has the shape of a radial cut opening outwardly and having a round bottom and acute side edges 21'*a*. The cutaway portion 21' of the rotor element 15 of the present embodiment is similar to that of the rotor element 15 incorporated in the viscous fluid type heat generator of the third embodiment as shown in FIG. 12.

The rotor element 15 is also provided with a plurality of (four) round through-holes 20 equiangularly arranged at a radially inner portion thereof extending around the center of the rotor element 15. The round through-hole 20 of the present embodiment is formed to be the same as that of the first embodiment as shown in FIGS. 2 and 3 except for having a smaller diameter as is understood from the comparison of the illustrations of FIGS. 12 and 17.

It should be noted that the heat generation control chamber CR of the viscous fluid type heat generator of the fourth embodiment is supplied with the viscous fluid, e.g., the silicone oil, so that substantially all of the thermo-sensitive spring coil 23 is submerged in the viscous fluid. Further, a given amount of air is unavoidably contained in the heat generation control chamber CR which enters therein when the heat generator is assembled.

The remaining construction of the heat generator of the fourth embodiment is similar to the construction of the heat generator of the first embodiment.

When the drive shaft 14 of the heat generator of the fourth embodiment is driven by an external drive source such as an automobile engine, the rotor element 15 is rotated in the fluid-tight heat generating chamber 8 so that the viscous fluid held in the gaps between the outer faces of the rotor element 15 and the inner wall surfaces of the fluid-tight heat generating chamber 8 generates heat due to a shearing action applied to the viscous fluid. The heat generated by the viscous fluid is transmitted to the water flowing through the front and rear heat receiving chambers FW and RW. Thus, the water carries the heat to an objective heated area such as a passenger cabin of the automobile.

When the heat generator is in operation, the rotation of the rotor element 15 causes the viscous fluid within the fluid-tight heat generating chamber 8 to be collected toward a radially central region of the fluid-tight heat generating chamber 8 by the known Weissenberg Effect. Particularly, since the cylindrical fluid-tight heat generating chamber 8 and the disc-like rotor element 15 define flat gaps in which the viscous fluid (the silicone oil) is extended in a large area lying in a plane perpendicular to the axis of rotation of the rotor element 15, the silicone oil can surely be subjected to the Weissenberg Effect so as to collect in the radially central region in the fluid-tight heat generating chamber 8.

Figure 15:
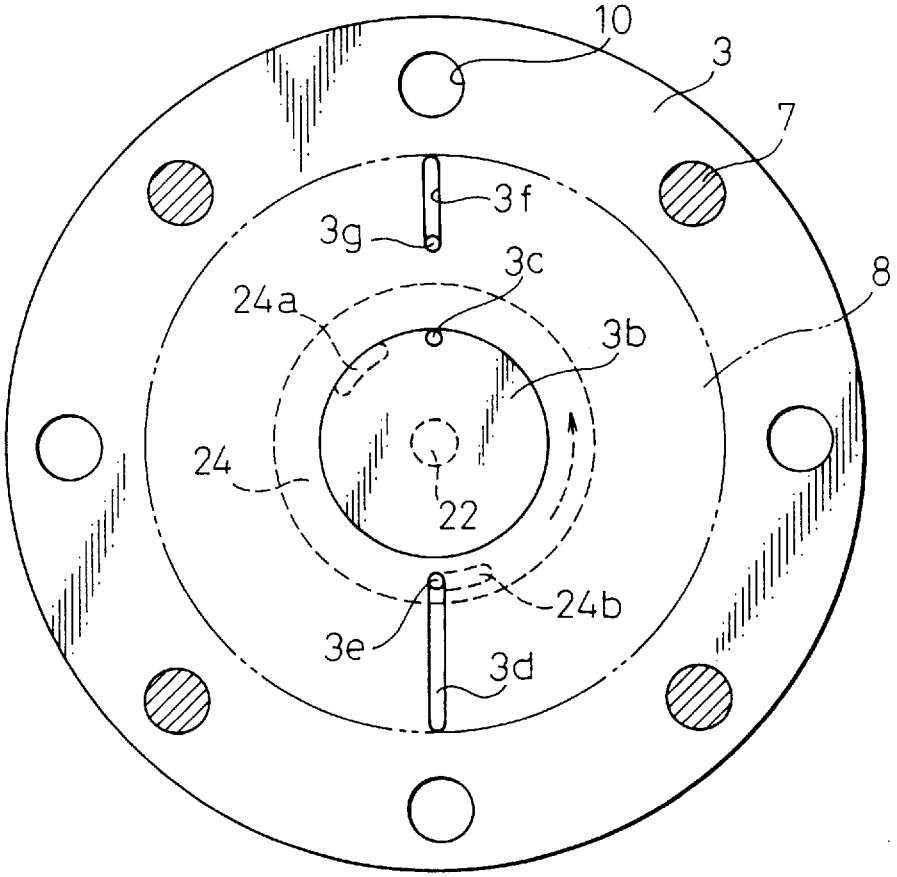
FIG. 15 is an end view of a rear plate element of the heat generator of FIG. 13, illustrating a state where heat generating performance is increased.
Figure 18:
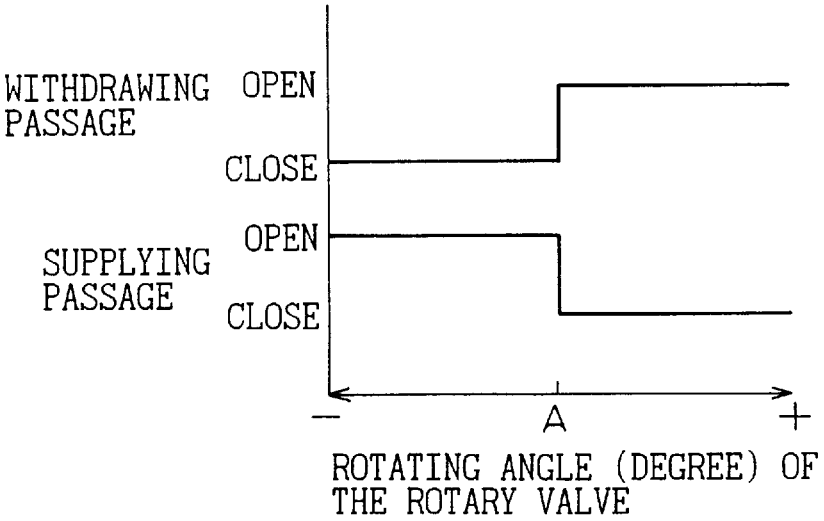

When the temperature of the silicone oil contained in the heat generation control chamber CR is lower than the predetermined reference temperature, the bimetal-coil-spring 23 rotates, via the valve shaft 22, the rotary valve 24 from a predetermined position "A" (see FIG. 18) in a direction shown by an dotted-line arrow in FIG. 15 to a position where the second fluid withdrawing passageway 24*a* of the rotary valve 24 is spaced away from and is not communicated with the first fluid withdrawing passageway 3*c*. At this stage, the first fluid supply passageway 3*e* is communicated with the second fluid supply passageway 24*b* of the rotary valve 24. Therefore, the fluid withdrawing passage between the fluid-tight heat generating chamber 8 and the heat generation control chamber CR is closed, and the fluid supply passage between the control chamber CR and the fluid-tight heat generating chamber 8 is opened. FIG. 18 schematically shows the closing state of the fluid withdrawing passage and the opened state of the fluid supply passage when the rotary valve 24 is rotated in a range of the abscissa designated by a minus symbol from the position "A". Thus, the withdrawal of the viscous fluid (the silicone oil) from the fluid-tight heat generating chamber 8 to the heat generation control chamber CR does not occur, and the supply of the viscous fluid from the heat generation control chamber CR to the fluid-tight heat generating chamber 8 occurs through the fluid supply passage including the second fluid supply passageway 24*b*, the first fluid supply passageway 3*e*, and the fluid supply channel 3*d*. During the supply of the silicone oil, the silicone oil entering from the heat generation control chamber CR into the gap on the rear side of the rotor element 15, the fluid-tight heat generating chamber 8 further flows into the gap on the front side of the rotor element 15 through the round through-holes 20. The supply of the silicone oil into the fluid-tight heat generating chamber causes the gaseous component, i.e., the air, to be purged from the fluid-tight heat generating chamber 8 via the radial gas channel 3*f* and the gas passageway 3*g* into the heat generation control chamber CR. Therefore, the air bubbles are removed from the gaps within the fluid-tight heat generating chamber 8, so that the heat generation by the viscous fluid, i.e., the silicone oil, is far activated to supply an increased amount of heat to an external heating system such as an automobile heating system.

Figure 16:
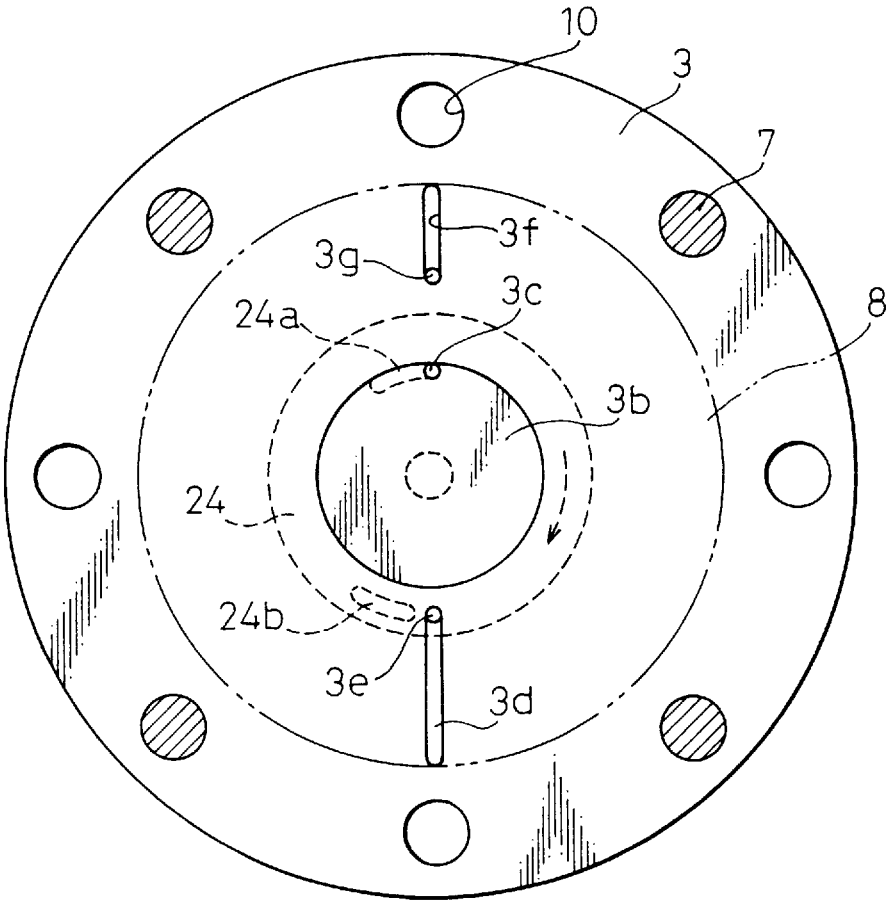
FIG. 16 is an end view of a rear plate element of the heat generator of FIG. 13, illustrating a state where heat generating performance is reduced.

On the other hand, when the temperature of the silicone oil within the heat generation control chamber CR is higher than the predetermined reference temperature indicating that heat application by the external heating system to the objective heated area is in excess, the bimetal-coil-spring 23 rotates the rotary valve 24 in a direction shown by a dotted line arrow in FIG. 16 from the position shown in FIG. 15 to the position of FIG. 16 where the first fluid withdrawing passageway 3*c* and the second fluid withdrawing passageway 24*a* are in registration with one another as shown in FIG. 16, but the first fluid supply passageway 3*e* comes out of registration with the second fluid supply passageway 24*b* of the rotary valve 24. Thus, the fluid withdrawing passage including the fluid collecting recess 3*b*, the first fluid withdrawing passageway 3*c*, and the second fluid withdrawing passageway 24*a* of the rotary valve 24 is opened between the fluid-tight heat generating chamber 8 and the heat generation control chamber CR, and simultaneously, the fluid supply passage between the heat generation control chamber CR and the fluid-tight heat generating chamber is closed in response to the rotation of the rotary valve 24 from the predetermined position "A", as schematically shown in FIG. 18 as a range (the abscissa) designated by a plus symbol. Therefore, the silicone oil is withdrawn from the fluid-tight heat generating chamber 8 into the heat generation control chamber CR. At this stage, the silicone oil held between the front end face 15*a* of the rotor element 15 and the inner wall surface 2*a* of the fluid-tight heat generating chamber 8 can be smoothly withdrawn through the round through-holes 20 of the rotor element 15. The silicone oil contained in the heat generation control chamber CR is prevented from being supplied therefrom into the fluid-tight heat generating chamber 8. Further, when the silicone oil is withdrawn from the fluid-tight heat generating chamber 8 into the heat generation control chamber CR, the gaseous component, i.e., the air in the heat generation control chamber CR is pressed by the silicone oil so as to flow from the heat generation control chamber CR into the fluid-tight heat generating chamber 8. Thus, the air bubbles are contained in the silicone oil held in the gaps between the inner wall surfaces and the outer faces of the rotor element 15 to reduce heat generation by the silicone oil. Accordingly, the amount of heat generating by the silicone oil in the gaps of the fluid-tight heat generating chamber 8 can be temporarily and conveniently reduced. Therefore, it is understood from the foregoing description that the viscous fluid heat generator of the fourth embodiment has a function of controlling the heat generating performance depending on a change in a demand of heating by the objective heated area. Further, since the viscous fluid heat generator of the fourth embodiment can control the heat generating performance by its internally accommodated mechanism including the thermo-sensitive bimetal-coil-spring actuator, the heat generator does not need a solenoid clutch between the external drive source and the drive shaft 14 of the heat generator, which is used for connection and disconnection of the supply of the external drive power. Thus, the heating system incorporating therein the viscous fluid type heat generator according to the fourth embodiment can be a lightweight and less expensive type heating system.

It should be noted that in the heat generator of the fourth embodiment, since the fluid-tight heat generating chamber 8, the heat generation control chamber CR, the fluid withdrawing passage, and the fluid supply passage are always maintained in a fluid-tight condition, during the supply and withdrawal of the silicone oil between the heating chamber 8 and the heat generation control chamber CR, no change in the internal volume occurs with respect to the above-mentioned fluid-tight heat generating chamber 8, the heat generation control chamber CR, the fluid withdrawing passage, and the fluid supply passage. Thus, the flow of the silicone oil does not produce any local pressure reduction in these chambers and passages. Accordingly, the air in the fluid-tight heat generating chamber 8 and the heat generation control chamber CR does not mix with the silicone oil during the flow of the silicone oil between both chambers 8 and CR. Thus, degradation of the silicone oil does not occur over a long operation time of the viscous fluid type heat. generator, and accordingly, the heat generator can maintain an excellent heat generating performance over a long operation time.

Further, the viscous fluid type heat generator of the fourth embodiment employs only one rotary valve for opening and closing both the fluid withdrawing and fluid supply passages. Therefore, the design of the heat generator having the excellent heat generation controlling performance can be an economical design.

It should be noted that the provision of the cutaway portions 21' and round through-holes 20 of the rotor element 15 permits the heat generator to increase an amount of heat generation due to an application of strong shearing action to the viscous fluid and to a large restraint against the movement of the viscous fluid caused by the rotor element 15. Namely, an increase in the amount of heat generation achieved by the heat generator according to the fourth embodiment due to the provision of the cutaway portions 21' and the round through-holes 20 can be considered to be equal to that achieved by the heat generator according to the first embodiment. Naturally, the provision of the cutaway portions 21' can contribute to distribution of the viscous fluid to many portions of the fluid-tight heat generating chamber 8 when the heat generator starts to operate and, accordingly, a quick start of the heat generating operation can be achieved by the viscous fluid type heat generator according to the fourth embodiment.

The provision of the round through-holes 20 in the radially inner portion of the rotor element 15 permits the viscous fluid to flow between the gaps on both front and rear sides of the rotor element 15. Therefore, a distribution of pressure of the viscous fluid can be equal to one another with respect to the viscous fluid held on both sides of the rotor element 15. Therefore, an equal amount of viscous fluid is constantly held on both sides of the rotor element 15 within the fluid-tight heat generating chamber 8, and accordingly, a constantly equal amount of heat can be generated by the viscous fluid in the fluid-tight heat generating chamber 8 on both sides of the rotor element 15 while preventing reduction in heat generation due to unequal distribution of the viscous fluid in the heat generating gaps on both sides of the rotor element 15.

In the viscous fluid type heat generator of the fourth embodiment, the heat generation control chamber CR is capable of storing a given amount of viscous fluid, in addition to the viscous fluid held in the fluid-tight heat generating chamber 8. Accordingly, a large amount of gaseous components, such as air, is held in an upper region of the fluid-tight heat generating chamber 8 when the operation of the heat generator is stopped. Therefore, when the heat generator of the fourth embodiment is compared with the heat generator of the first embodiment having no heat generation control chamber CR, the fluid distributing effect achieved by the cutaway portions 21' of the rotor element 15 according to the fourth embodiment is advantageous over that achieved by the first embodiment.

Furthermore, according to the viscous fluid type heat generator of the fourth embodiment, even when the amount of the viscous fluid held in the fluid-tight heat generating chamber 8 is reduced due to the withdrawal of the viscous fluid from the fluid-tight heat generating chamber to the control chamber, and even when the rotating speed of the rotor element 15 is small, the cutaway portions 21' of the rotor element 15 can carry and distribute the viscous fluid in the lower region of the fluid-tight heat generating chamber 8 to many portions in the gaps of the fluid-tight heat generating chamber 8. Thus, the small heat generating performance of the heat generator can be quickly converted into a large heat generation performance.

From the foregoing description of the various preferred embodiments of the present invention, it will be understood that in accordance with the present invention, the viscous fluid type heat generator can effectively increase an amount of heat generation by the viscous fluid in response to a demand by a heating system employing the heat generator. Further, it will be understood that, in accordance with the present invention, the viscous fluid type heat generator can increase an amount of heat generation by an effective increase in a heat generating region formed by the gaps within the fluid-tight heat generating chamber. Further, an operation reliability and operation life of the viscous fluid type heat generator can be increased.

Many variations and modifications will occur to a person skilled in the art without departing from the scope and spirit of the invention as claimed in the accompanying claims.

What we claim is:

1. A viscous fluid type heat generator which comprises:

a housing assembly defining therein a fluid-tight heat generating chamber in which heat is generated, and a heat receiving chamber arranged adjacent to said fluid-tight heat generating chamber for permitting a heat exchanging fluid to circulate therethrough to thereby receive heat from said fluid-tight heat generating chamber, said fluid-tight heat generating chamber having inner wall surfaces thereof;

a drive shaft supported by said housing assembly to be rotatable about an axis of rotation thereof, said drive shaft being operationally connected to an external rotation-drive source;

a rotor element mounted to be rotationally driven by said drive shaft for rotation together therewith within said fluid-tight heat generating chamber, said rotor element having outer faces confronting said inner wall surfaces of said fluid-tight heat generating chamber via a predetermined amount of gap to generate heat; and, a viscous fluid, filling said gap between said inner wall surfaces of said fluid-tight heat generating chamber of said housing assembly and said outer faces of said rotor element, for heat generation by the rotation of said rotor element, wherein said rotor element is provided with a first recess means formed in an outer peripheral portion thereof, and, wherein said inner wall surfaces of said fluid-tight heat generating chamber is provided with a second recess means arranged in a portion thereof permitting said second recess means to confront at least a portion of said first recess means in response to the rotation of said rotor element, said first and second recess means cooperating with one another to expand a region formed by said gap of said fluid-tight heat generating chamber when said rotor element is rotated.

2. A viscous fluid type heat generator according to claim 1, wherein said first recess means formed in said outer peripheral portion of said rotor element includes at least one through-hole arranged to pierce opposite circular end faces of said rotor element at a position in said outer peripheral portion of said rotor element.

3. A viscous fluid type heat generator according to claim 2, wherein said first recess means formed in said outer peripheral portion of said rotor element includes a plurality of through-holes arranged to pierce the opposite circular faces of said rotor element at a plurality of equiangularly spaced positions in said outer peripheral portion of said rotor element.

4. A viscous fluid type heat generator according to claim 3, wherein said plurality of through-holes arranged in said outer peripheral portions of said rotor element includes eight equiangularly arranged through-holes having an equal diameter.

5. A viscous fluid type heat generator according to claim 2, wherein said through-hole is formed by a through-hole in the shape of a circle having a center thereof located at a position radially spaced from the axis of rotation of said rotor element by a distance equal to or larger than ($0.3 \times r_0$), and a radius in the range of ($0.05 \times r_0$ through $0.15 \times r_0$), where "$r_0$" indicates the radius of said rotor element.

6. A viscous fluid type heat generator according to claim 1, wherein said first recess means formed in said outer peripheral portion of said rotor element comprises at least one cutaway portion arranged in an outer circumference of said rotor element.

7. A viscous fluid type heat generator according to claim 6, wherein said cutaway portion of said rotor element comprises a radially outwardly opening cut with respect to the axis of rotation of said rotor element.

8. A viscous fluid type heat generator according to claim 1, wherein said second recess means of said inner wall surfaces of said fluid-tight heat generating chamber comprises at least one indentation formed in respective inner wall surface portions of said inner wall surfaces which face opposite circular end faces of said rotor element, and arranged to extend in a direction different from a circumferential direction about the axis of rotation of said rotor element.

9. A viscous fluid type heat generator according to claim 8, wherein said indentation formed in said inner wall surface portions of said inner wall surfaces of said fluid-tight heat generating chamber comprises an elongate indentation having a center line angularly shifted from a radial line in a direction corresponding to the direction of rotation of said rotor element so that the viscous fluid is moved radially toward a radially outer region of said gap from a radially inner region thereof by the guidance of said elongate indentation during the rotation of said rotor element.

10. A viscous fluid type heat generator according to claim 1, wherein said second recess means of said inner wall surfaces of said fluid-tight heat generating chamber comprise a plurality of indentations formed in respective inner wall surface portions of said inner wall surfaces which face opposite circular end faces of said rotor element, said plurality of indentations being arranged to extend in a direction different from a circumferential direction about the axis of rotation of said rotor element.

11. A viscous fluid type heat generator according to claim 10, wherein said plurality of indentations formed in said respective inner wall surface portions of said inner wall surfaces of said fluid-tight heat generating chamber comprise a plurality of elongate indentations, each having a center line angularly shifted from a radial line in a direction corresponding to the direction of rotation of said rotor element so that the viscous fluid is moved radially toward a radially outer region of said gap from a radially inner region thereof by the guidance of said elongate indentation during the rotation of said rotor element.

12. A viscous fluid type heat generator according to claim 1, wherein said first recess means of said rotor element comprises a plurality of through-holes or cutaway portions arranged at a plurality of equiangularly spaced positions in said outer peripheral portion of said rotor element, and said second recess means of said inner wall surfaces of said fluid-tight heat generating chamber comprises a plurality of indentations arranged at a plurality of equiangularly spaced positions, said space between two neighboring through-holes or cutaway portions of said rotor element being selected to be different from that between two neighboring indentations of said inner wall surfaces of said fluid-tight heat generating chamber.

13. A viscous fluid type heat generator according to claim 12, wherein said plurality of through-holes or cutaway portions include eight through-holes or cutaway portions, and wherein said plurality of indentations include nine elongate indentations.

14. A viscous fluid type heat generator according to claim 1, wherein at least one of said first recess means of said rotor element and said second recess means of said inner wall surfaces of said fluid-tight heat generating chamber is provided with acute edges at portions thereof exposed to the gap.

15. A viscous fluid type heat generator according to claim 1, wherein said housing assembly further defines a fluid storing chamber fluidly communicating with said fluid-tight heat generating chamber by a fluid supplying passageway and a fluid withdrawing passageway, said fluid storing chamber having a capacity thereof sufficient for storing a given volume of the viscous fluid which is larger than the capacity of said predetermined gap between said inner wall surfaces of said fluid-tight heat generating chamber and said outer faces of said rotor element.

16. A viscous fluid type heat generator according to claim 1, wherein said housing assembly further defines a heat generation control chamber fluidly communicating with said fluid-tight heat generating chamber by a fluid supplying passageway and a fluid withdrawing passageway, one of said fluid supplying and fluid withdrawing passageways being arranged to be opened and closed by a valve means, so that when the viscous fluid is withdrawn from said fluid-tight heat generating chamber into said heat generation control chamber via said fluid withdrawing passageway, the heat generating performance of said heat generator is reduced, and that when the viscous fluid is supplied from said heat generation control chamber into said fluid-tight heat generating chamber via said fluid supplying passageway, said heat generating performance of said heat generator is increased.

17. A viscous fluid type heat generator which comprises:

a housing assembly defining therein a fluid-tight heat generating chamber in which heat is generated, and a heat receiving chamber arranged adjacent to said fluid-tight heat generating chamber for permitting a heat exchanging fluid to circulate therethrough to thereby receive heat from said fluid-tight heat generating chamber, said fluid-tight heat generating chamber having inner wall surfaces thereof;

an axial drive shaft supported by said housing assembly to be rotatable about an axis of rotation thereof, said drive shaft being operationally connected to an external rotation-drive source;

a rotor element mounted to be rotationally driven by said drive shaft for rotation together therewith within said fluid-tight heat generating chamber, said rotor element having front and rear opposite end faces and an outer circumferential face which confront said inner wall surfaces of said fluid-tight heat generating chamber via predetermined amount of gaps to genetate heat; and, a viscous fluid, filling at least said gaps between said inner wall surfaces of said fluid-tight heat generating chamber of said housing assembly and said front and rear opposite end faces of said rotor element, for heat generation by the rotation of said rotor element, wherein said rotor element is provided with at least one first through-hole axially piercing a portion thereof extending around and arranged radially adjacent to an axis of rotation of said rotor element, said first through-hole permitting the viscous fluid held in said predetermined gaps to pass therethrough from one side to the other of said rotor element, and, wherein said inner wall surfaces of said fluid-tight heat generating chamber is provided with a second recess means arranged in a portion thereof permitting said second recess means to confront at least a portion of said first recess means in response to the rotation of said rotor element, said first and second recess means cooperating with one another to expand a region formed by said gap of said fluid-tight heat generating chamber when said rotor element is rotated.

18. A viscous fluid type heat generator according to claim 17, wherein said rotor element is further provided with a recess means formed therein at a portion of at least one of said front and rear end faces thereof, and located radially outside said first through-hole.

19. A viscous fluid type heat generator according to claim 18, wherein said recess means of said rotor element comprises at least one second through-hole piercing said front and rear end faces of said rotor element.

20. A viscous fluid type heat generator according to claim 18, wherein said inner wall surfaces of said fluid-tight heat generating chamber are provided with a recessed portion formed therein and confronting said recess means of said rotor element during the rotation of said rotor element.

21. A viscous fluid type heat generator according to claim 20, wherein said recessed portions of said inner wall surfaces of said fluid-tight heat generating chamber comprise at least one elongate indentation formed therein and having a portion thereof confronting said recess means of said rotor element during the rotation of said rotor element, said elongate indentation being arranged to extend in a direction different from a circumferential direction with respect to the axis of rotation of said rotor element.

22. A viscous fluid type heat generator according to claim 21, wherein said rotor element is provided with a plurality of said first through-holes and a plurality of said second through-holes, and said inner wall surfaces of said fluid-tight heat generating chamber are provided with a plurality of said elongate indentations, said first through-holes, said second through-holes and said elongate indentations being arranged at respective predetermined circumferential spaces about the axis of rotation of said rotor element.

23. A viscous fluid type heat generator which comprises:

a housing assembly defining therein a fluid-tight heat generating chamber in which heat is generated, and a heat receiving chamber arranged adjacent to said fluid-tight heat generating chamber for permitting a heat exchanging fluid to circulate therethrough to thereby receive heat from said fluid-tight heat generating chamber, said fluid-tight heat generating chamber having inner wall surfaces thereof;

an axial drive shaft supported by said housing assembly to be rotatable about an axis of rotation thereof, said drive shaft being operationally connected to an external rotation-drive source;

a rotor element in the form of a disc mounted to be rotationally driven by said drive shaft for rotation together therewith within said fluid-tight heat generating chamber, said rotor element having front and rear opposite end faces and an outer circumferential face which cooperate with said inner wall surfaces of said fluid-tight heat generating chamber to define predetermined amount of gaps therebetween; and, a viscous fluid filling said gaps for heat generation by the rotation of said rotor element, wherein said rotor element is provided with a plurality of first through-holes piercing a radially central portion of said rotor element, and a plurality of second through-holes piercing a radially outer portion of said rotor element, said first and second through-holes being arranged at predetermined respective angular spaces, and, wherein said inner wall surfaces of said fluid-tight heat generating chamber are provided with a plurality of indentations formed in a wall surface portion thereof confronting the opposite end faces of said rotor element and arranged at a predetermined angular space, each indentation being elongated to have a centerline thereof angularly shifted from a radial line in a rotating direction of said rotor element about the axis of rotation of said rotor element.

* * * * *